United States Patent [19]

Smith

[11] Patent Number: 4,926,746

[45] Date of Patent: May 22, 1990

[54] WORK CHAMBER WITH SHIFTING VENTILATION ZONE

[76] Inventor: Clyde M. Smith, 1705 Green Hills Dr., Nashville, Tenn. 37215

[21] Appl. No.: 298,042

[22] Filed: Jan. 18, 1989

Related U.S. Application Data

[63] Continuation-in-part of Ser. No. 141,097, Jan. 5, 1988, abandoned.

[51] Int. Cl.[5] ..... B05B 15/12

[52] U.S. Cl. ..... 98/115.2; 98/115.4; 118/326

[58] Field of Search ..... 98/115.2, 115.4; 118/326

[56] References Cited

U.S. PATENT DOCUMENTS

| | | | |
|---|---|---|---|
| 2,634,560 | 4/1953 | Ramm | 98/115.4 X |
| 2,743,661 | 5/1956 | Schanz | 98/115.4 X |
| 2,829,582 | 4/1958 | Abbott et al. | 98/115.2 |
| 3,465,805 | 6/1976 | Muehlbauer | 118/326 |
| 3,807,291 | 4/1974 | Roberts et al. | 98/115.2 |
| 4,048,912 | 9/1977 | Walker | 118/634 |
| 4,133,255 | 1/1979 | Guice | 98/115.2 |
| 4,223,599 | 9/1980 | Napadow | 118/DIG. 7 X |
| 4,230,032 | 10/1980 | Perryman | 118/326 X |
| 4,425,839 | 1/1984 | Stall | 98/40.01 |
| 4,537,120 | 8/1985 | Josefsson | 98/115.2 |
| 4,549,472 | 10/1985 | Endo et al. | 98/31.5 |
| 4,616,594 | 10/1986 | Itho | 98/115.2 X |

FOREIGN PATENT DOCUMENTS

| | | | |
|---|---|---|---|
| 6120 | 1/1980 | European Pat. Off. | 98/115.2 |
| 26359 | 3/1981 | European Pat. Off. | 118/DIG. 7 |
| 2936367 | 3/1981 | Fed. Rep. of Germany | 98/115.2 |
| 2272752 | 12/1975 | France | 98/115.2 |
| 2416628 | 8/1979 | France | 98/115.2 |
| 516875 | 6/1976 | U.S.S.R. | 98/115.4 |
| 547595 | 5/1977 | U.S.S.R. | 98/115.4 |
| 580414 | 11/1977 | U.S.S.R. | 98/115.2 |

*Primary Examiner*—Harold Joyce

*Attorney, Agent, or Firm*—Sutherland, Asbill & Brennan

[57] ABSTRACT

A ventilated work chamber, e.g., a paint booth, large enough to allow a worker to move about inside is improved by confining the zone (or path) of the fresh ventilating air to just a portion of the cross section of the chamber, and providing means for shifting the location of the ventilating air zone from one place to another in the chamber, as the worker changes his location.

25 Claims, 17 Drawing Sheets

WORK CHAMBER WITH SHIFTING VENTILATION ZONE

This application is a continuation-in-part of copending application Ser. No. 07/141,097, filed Jan. 5, 1988 now abandoned.

The present invention relates to ventilated work chambers such as paint spray booths. More particularly, it relates to means for reducing some of the equipment and operating costs for ventilated work chambers by use of a mobile ventilation zone that is smaller than the entire chamber space and which can follow the work activity around the booth.

When a painter sprays paint on a part, only about 60 % of the paint actually lands and sticks to the part. The other 40 % forms a paint fog which drifts and settles wherever it may as a sticky dust. This wasted paint is called overspray. If the overspray drifts and settles on a freshly painted surface, it makes an undesirably rough and dusty finish.

Although a paint booth is not essential for quality paint jobs, it provides important production features. The draft in a ventilated paint booth removes the oversprayed paint so that it does not land on the parts or the floor. In addition, the paint booth normally is equipped with lights and air heaters so that paint operations can take place day or night, in any season.

Freshly painted surfaces give off solvent vapors which are harmful to breathe. The overspray contains harmful vapors and paint particles. The U.S. Occupational Safety and Health Administration (OSHA) requires that paint booths be designed to protect the painter from most of the harmful vapors and particles. The air from the paint booth containing the vapors and particles must be exhausted through a stack to the atmosphere, to protect the workers inside the building.

The U.S. Environmental Protection Agency (EPA) requires that the vapors and particles be removed from the paint booth exhaust stack to protect the general public. Therefore, the paint booth must be designed to protect the part from overspray, protect the painter from vapors and particles, and, finally, protect the general public from the vapors and particles. Similar requirements apply to other ventilated work chambers.

The capital and operating costs of a ventilated work chamber are directly related to the amount of air the chamber uses. In the case of very large paint booths, the cost of buying and operating the equipment required by the EPA for protecting the public can be millions of dollars. If the amount of air used by the booth could somehow be cut in half, the cost of the EPA equipment could also be cut approximately in half.

The ventilating air in a ventilated work chamber may be introduced as fresh air or as a mixture of fresh air and recirculated air. When the ventilating air leaves the work chamber, at least a portion of this ventilating air will be exhausted to atmosphere or to a device for further treatment. This exhausted air represents the quantity of ventilating air that is used, consumed, required or spent during operation of the ventilated work chamber. A like amount of fresh air will be introduced into the work chamber to replace this exhausted air. Therefore, any reduction in rate of exhausted air results in a like reduction of fresh supply air. Recirculated air is typically considered to be air that makes more than one pass through the work chamber and, although it may be breathable, in most instances it is considered unsuitable for breathing. Fresh air is typically considered to be air delivered to the work chamber suitable for breathing without any further treatment.

I have invented an improved type of ventilated work chamber. The invention is applicable to work chambers that are large enough to accommodate a worker and allow him to move about in the chamber and perform work activity in different locations in a work zone in the chamber. The chamber should have a ventilating air supply face on one side of the work zone and a ventilating air exhaust face on a different side of the work zone and be equipped with means for continuously passing a stream (or draft) of ventilating air through the work zone of the chamber. The exhaust face need not be a visible structure. It is the plane that can be said to divide that area of the work chamber wherein the workpiece is located from the chamber beyond, into which the exhaust air is pushed or pulled. (The latter chamber sometimes will be referred to herein as an exhaust chamber.) The ventilating air is pulled in (or pushed) through the supply face, then through or across the work zone, and out through the exhaust face. The direction of flow of the ventilating air may be thought of as being substantially perpendicular to one cross section of the work chamber (hereinafter sometimes referred to as the "ventilated cross section" of the chamber). The chamber should also include means for exhausting to the atmosphere at least part of the air that is drawn (or pushed) out through the exhaust face of the chamber.

My invention resides in equipping such a chamber with means for substantially confining the fresh air component of the stream of ventilating air to a ventilation zone (or path) having a smaller cross section than the cross section of the chamber, and with means for shifting the location of the ventilation zone about the chamber as the work activity shifts about the chamber. In this way one is able to conserve the use of fresh air but still constantly maintain a flow of fresh ventilating air through the location of the work activity, even though that location moves from place to place in the plane of the cross section of the chamber. This provides substantial savings over the cost of building and operating the same size work chamber with constant fresh air ventilation throughout. This confined stream of fresh ventilating air will sometimes be referred to herein as a "mobile zone".

The invention described is applicable to ventilated work chambers which are provided for the benefit of worker and product. The work activity contemplated includes surface coating, surface stripping, and surface cleaning, as well as other manufacturing and fabrication operations which require ventilation, such as the spraying and lay-up of fiberglass products. The most common ventilated work chambers in use today are spray booths for painting. The next most common ventilated work chambers are booths for the lay up and spraying of fiberglass or composite products. The invention will reduce the quantity of fresh ventilating air required to safely and efficiently ventilate the work chamber, by up to 95 percent. In turn, this can reduce the capital and operating cost of heating, cooling and volatile organic compounds (VOC) emission control equipment by approximately the same percentage. The purpose of the invention is to reduce the cost of temperature, humidity and pollution control associated with ventilated work chambers, thereby bringing these desirable features within the economic reach of everyone who uses such facilities.

The design of the present invention can be used with work chambers either of the down draft or side draft type. In a down draft chamber the exhaust face is the grilled floor of the work chamber. If one thinks of a side draft chamber as having an upstream end and a downstream end (with reference to the path of the ventilating air), then the exhaust face in a side draft chamber is a vertical plane marking the downstream end.

To set the present invention in perspective, the following describes its place among the two contending operational methods: conventional and recirculation. At one extreme, a conventional spray booth utilizes fresh air across it entire cross section for the benefit of the worker and his work activity. The many improvements described in practice and disclosed in the patent literature illustrate means for dividing this cross section into fixed or rearrangable zones of varying velocities to minimize total air consumption. Unfortunately, in each case these methods reduce the air consumption by only about 10 to 30 percent, and, additionally, they are limited by product, scale or industry.

At the other extreme, a recirculation booth utilizes recirculated air across its entire cross section for the benefit of the work activity; separate fresh air must be supplied through a flexible hose to a "space suit" which the worker occupies. From the practical point of view, the worker is so encumbered by the suit, suit hose, spray equipment and spray equipment hoses that he can barely do his job. The recirculation method is very efficient, however, reducing air consumption by up to 95 percent. Unfortunately, the recirculation design does not meet OSHA standards, and as a result a variance from OSHA is required to legally operate this type of booth. OSHA no longer provides variances for recirculation designs, however, due to the heightened concern over the method's inherent dangers. OSHA's reasoning is that intentionally placing a worker in a contaminated environment on a repeated basis with such insubstantial protection is too risky.

The present invention provides an operational method between these two extremes. It provides fresh ventilating air for the benefit of the worker and his work activity across only a portion of the work chamber cross section. In addition, the zone of fresh ventilating air shifts in location, in response to the shifting locational needs of the work activity. The balance of the cross section of the chamber may optionally be ventilated with recirculated air. Therefore, the present invention uses features common to each extreme, but in a unique combination. The present invention improves on the safety of a conventional spray booth while avoiding its extravagant waste; the present invention is as efficient as the recirculation method without its inherent danger. The present invention occupies the middle ground between these two extremes.

To further delineate the fundamental differences in the conventional design, the recirculation design, and the design of the present invention, one can consider how work chamber exhaust rates are determined. For the conventional design, the exhaust rate is set by the size of the ventilated cross section of the work chamber. In such a design the exhaust rate is essentially proportional to the size of the booth. For the recirculation design, the exhaust rate is set by the quantity of fresh air required to dilute the ventilation air below 25 percent of what is referred to as the "lower explosive limit". In that design, then, the exhaust rate is essentially proportional to the level of work activity, e.g., the peak volatile spray rate. For the design of the present invention, the exhaust rate is set instead by the size of the ventilation zone required for the worker or workers in the chamber. Thus, the exhaust rate is generally proportional to the number of workers who must work simultaneously in the chamber.

Any of a wide variety of means may be used in the chamber of the present invention for confining the fresh air component of the stream of ventilating air to a mobile zone. Thus, for example, an array of dampers may be used to divide up the exhaust face, or a mobile, open cab may be used to carry (or transport) the worker, with means for delivering the fresh air to the cab from the rear. As another alternative, a substantially air impervious curtain panel, with an opening therein, can be located either at the exhaust face or the supply face, or both. The panel should be operable to move back and forth in the plane of the face, the opening in the panel serving to define the path of the fresh ventilating air. Each of these embodiments will be described in detail later herein.

As mentioned, in some work chambers it is necessary not only to provide a flow of ventilating air over the worker (which must include or consist of fresh air) but also to provide a steady draft through the entire chamber. This might be necessary, for example, to prevent turbulence in the chamber, or to prevent overspray. In the chamber of the present invention substantially no fresh air is used, except to flow over the worker. Thus, if it is necessary to sweep air through the rest of the chamber as well, only recirculated air need be used for that.

Preferably, the work chamber also will be equipped with means for removing suspended solids and mist from the air pulled from the work chamber. Most often this will be either a dry filter, e.g., a fiberglass pad, or a water scrubber. Often it will be preferred to have a water scrubber in the exhaust chamber. Thus, for example, the exhaust chamber may contain means for delivering a continuous spray of the water into the air moving through the chamber. As is well known in the art, the water may contain various chemical additives to detoxify the contaminants (e.g., paint) that is entrained in the water, to prevent corrosion and scaling of the pumps and other equipment, etc.

Where rigorous control over the release of volatile organic compounds to the atmosphere is needed, the booth also can be equipped with a VOC emission control afterfilter. This will be located downstream of the first stage cleansing means, i.e., the dry filter or water scrubber. In the case of paint booths it normally will be comprised of a carbon adsorption filter and/or a regenerative incinerator for consuming the paint overspray and solvent fumes. Using the booth design of the present invention, the size of the VOC emission control afterfilter can be substantially smaller than if the entire work chamber were constantly ventilated.

Where the work chamber is a paint booth, it preferably also will include means for containing a pool of water in the exhaust chamber, over which the air pulled from the chamber passes. As is well known in the art, this pool serves to catch paint particles as they settle out of the exhaust air and prevent them from drying into a hardened mass. The paint collects on the bottom of the pool as a gummy substance that periodically can be scraped up and removed. Advantageously, the pool containment means will be operable to receive water from the scrubber and recirculate it.

The improved design of the present invention can be used with enclosed work chambers as well as with open or semi-enclosed ones. In open work chambers fresh air flows in from the surrounding atmosphere in the building. Enclosed chambers may be equipped with a supply air chamber in communication with the work chamber. The supply air chamber is adapted to conduct fresh air into the work chamber to replace the air which is pulled from the work chamber by the exhaust and/or recirculation fan. In temperate or colder climates it is common for a work chamber to be equipped with thermostatically controlled means for heating the supply air before it enters the work chamber, as well as means for filtering dust out of the air. Fiberglass pads often are used as the dust filters. The supply air chamber may have such heating and filtering equipment mounted therein, as well as a humidifier and a supply fan. Often the supply air chamber will be in communication with a separate stack, through which fresh air is drawn from the atmosphere. In accordance with the present invention, the supply air chamber preferably will also be equipped with a supply airflow control damper that is operable to modulate the rate of fresh air flow into the work chamber.

The supply air chamber and the work chamber are separated by the supply face of the work chamber, which may be thought of as a boundary plane. Preferably, the supply face is opposite and substantially parallel to the exhaust face of the work chamber. Thus, in an enclosed down draft booth the supply face usually will be the ceiling of the work chamber. In an enclosed side draft booth the supply face usually will be in the vertical boundary plane opposite the exhaust face.

The work chamber of the present invention preferably also includes timing means for measuring the length of time during which no work is taking place in the chamber. Coupled with this may be means, responsive to a determination by the timing means that no work has occurred for a predetermined length of time (e.g., no paint has been sprayed) for reducing the volume of air pulled by the exhaust fan, e.g., by slowing down the exhaust fan and/or by adjusting an air flow control damper in the exhaust conduit. If a supply air fan is used, it too can be slowed down and/or the supply air flow control damper can be partially closed. This is an energy saving feature, useful for automatically reducing the airflow through the work chamber when no work is taking place. Similarly, the work chamber may be equipped with means for lowering the temperature setting of the thermostat that controls the heating means for the supply air, when the timing means indicates that no work has taken place in the chamber for a predetermined length of time. Conversely, if the supply air chamber is equipped with an air conditioner, then in warm weather the inactivity may trigger an elevation of the thermostat temperature setting.

Ideally, the timing means also will serve to shut off altogether the fan and the air heating means, and close all dampers, once it determines that no work has been performed in the chamber for still a longer period of time. In this way, if, at the end of the workday, the worker neglects to turn off these utilities, they will be automatically shut down before very long. For example, in a paint booth the non-spraying time that triggers the slowdown, i.e., a reduction in air flow rate, might be approximately eight minutes. In contrast thereto, it may require a 30 minute period of inactivity before shutdown is reached, i.e., the exhaust and supply fans are turned off entirely and the heater thermostat is turned down.

Ventilated work chambers normally are equipped with electric lights to illuminate their interiors. It is advantageous if the shut-down means just mentioned also is operable to turn off most or all of the electric lights in response to a determination by the timing means that no work has been performed in the chamber for a predetermined length of time.

Mobile Zone System With Array of Exhaust Dampers

As mentioned, the means for confining the path of ventilating air can be supplied by any one of a variety of different mechanisms. For example, the chamber may be equipped with a plurality of exhaust dampers, each of which is operable to control the flow of air through a different section of the exhaust face. Collectively, the exhaust dampers are operable to control the flow of air through all sections of the exhaust face. In this embodiment means are also provided for opening and closing the dampers independently of one another, so as to enable the air to be drawn through less than all of the sections of the exhaust face at any one time. This makes it possible for the path of airflow through the work chamber to be localized and shifted from place to place in the chamber by opening and closing different exhaust dampers.

The exhaust dampers may be located at the exhaust face of the work chamber. Alternatively, they may be located downstream of the exhaust face, but in this case they preferably are isolated one from another by partitions that extend between the dampers and the exhaust face. The partitions, which are parallel to the direction of flow of air through the exhaust chamber, serve to define the path of airflow through the exhaust face.

The exhaust dampers can be opened and closed singly or in groups. Thus the path of airflow through the work chamber can be varied both in size and location. Where work activity is taking place at more than one location in the work chamber, a separate path of airflow can be established to ventilate each of the workers.

Each exhaust damper may advantageously comprise a stationary frame that defines an air passage opening and a blade that is pivotably mounted in the frame. The blade should be adapted to be turned between a damper-closed position, in which the blade substantially closes the opening in the frame, and a damper-open position, in which the blade is substantially parallel to the direction of airflow through the damper. When the chamber is to be used as a paint booth, ideally the damper will have no seat for the blade to seal against when in the damper-closed position. This is to avoid the problem of the damper sticking shut due to the adhesive effect of paint particles that collect on the seat or the blade.

It is also preferred that the exhaust damper blade be slightly smaller than the air passage opening and that the blade be mounted substantially in the center of the frame. This leaves a narrow space between the edges of the blade and the frame when the damper is closed, which serves two purposes. First, it reduces the chances of the damper sticking closed due to paint build-up between the blade and the frame. Second, it can assure that whenever the exhaust fan is running there is at least a small amount of air being pulled through each area of the work chamber. In this way, when the painting activity shifts from one location in the chamber to another, and dampers are opened and closed accordingly, there still will be a small amount of ventilation occurring where the freshly painted surface is, even though the damper controlling that area is in the closed position. This leakage around the edges of the closed blade is useful, in that it helps remove the volatile organic components that evaporate from the paint as it hardens and cures.

Preferably the exhaust dampers are pneumatically actuated. Electric actuators are less desirable because of the danger that an electrical spark will ignite flammable vapors in the work chamber. The air cylinder that moves the damper blade preferably is cushioned, so as to operate quietly. The air lines to the cylinder will be connected to solenoid valves located outside the chamber, away from the paint vapors.

Backdraft exhaust dampers can be used as well, if each damper has its own dedicated exhaust fan. In that case the damper is opened by actuating the exhaust fan and is closed by turning the fan off. This is a less desirable arrangement, however, due to the greater equipment cost, slower response time, and lack of useful leakage ventilation in all sections of the work chamber.

The exhaust damper blades preferably are all aligned in the same plane when in the closed position. The dampers can either be arranged in a single row or in a panel of two or more rows.

Where a down draft booth is used, the floor of the work chamber will be in the form of a grate. The space beneath the floor grate constitutes part of the exhaust chamber. This space can advantageously be partitioned into open-top, parallel, horizontal channels that extend substantially completely across the work chamber. One end of each of the channels can be fitted with one of the exhaust dampers. Ideally, all of the dampers in these channels will be substantially aligned in the same vertical plane when in the closed position. Preferably, all of the dampers will open into an enclosed outer chamber which is faced by the downstream sides of the dampers. The outer chamber is a continuation of the exhaust chamber. It serves as a manifold, connecting the inner exhaust chamber with an exhaust conduit, e.g., a stack that vents the exhaust air to the atmosphere. Thus the wall of dampers effectively divides the exhaust chamber into inner and outer chambers.

In a down draft work chamber with channels beneath the floor grate, the pool of water preferably will be contained both in the channels underneath the floor grate and in the outer chamber. In this embodiment each damper frame also may have a second opening that is below the air passage opening and which permits circulation of the water between the channel and the outer chamber. In this arrangement the means for containing the water preferably will be operable to maintain the water level below the air passage opening but above the second opening.

If it is desired that the zone of ventilation in the work chamber be kept as narrow and precisely defined as possible, the work chamber may also include a plurality of supply dampers, each of which is operable to control the flow of supply air through a different section of the supply face, with the supply face being opposite the exhaust face. The means for opening and closing each exhaust damper should serve to open or close in tandem therewith a supply damper that controls the flow of supply air through a section of the supply face that is substantially opposite that section of the exhaust face that is controlled by the exhaust damper. Preferably an equal number of supply and exhaust dampers will be used.

Similar to the situation with the exhaust dampers, the supply dampers either should be located at the supply face or be upstream of the supply face, but isolated one from another by partitions that extend between the dampers and the supply face. By opening and closing opposing dampers in unison, a well defined horizontal or vertical column of moving air can be directed through the work chamber and located only in the zone where ventilation is needed. In this way less air needs to be moved. Damper costs are approximately doubled with this arrangement, however.

It is also possible, but less desirable, to use an array of dampers only at the supply face of the work chamber. The same control means can be used to open and close individual dampers as the worker moves about in the chamber, so as to allow fresh air to enter the chamber only in the region where the work activity is occurring.

The opening and closing of the dampers for the work chamber can be controlled by hand operation of a control mechanism adapted to be carried by the worker in the chamber. Thus, for example, a pneumatically operated control pendant can be hung from a paint spray gun. Zones of the work chamber can be designated by different switches or switch positions on the pendant. As the worker moves from one zone to another he can adjust the switches accordingly, to keep the flow of ventilation air with him. This arrangement works best for a work chamber in which work or movement about the chamber is relatively slow. Thus, for example, for a work chamber 200 feet long, a control pendant having 5 buttons may be used. Each button would control a 40 foot segment of the ventilation cross section of the chamber.

Alternatively, the work chamber may be equipped with means, responsive to the shifting of work activity from one location in the work chamber to another, for automatically closing the exhaust damper that controls the flow of air through the area which the painter departs and opening the damper controlling the airflow in the area being entered. Thus, as the work activity shifts from a location in the work chamber opposite a first section of the exhaust face to a location opposite a second section of the exhaust face, the control means closes the damper that controls the flow of air through the first section and opens the damper that controls the flow of air through the second section. Such automatic response means has the advantage that it does not depend on the worker remembering to adjust switches on his portable control panel as he moves about the chamber.

In a paint booth the fact that painting is taking place at all in the booth may be sensed from the flow of the compressed air or paint which supplies the gun. The precise location of the painting activity may be determined by manual or automatic position sensors. A hand operated control pendant is an example of a manual position sensor. As automatic sensors, pressure sensitive floor mats can be used. Infrared motion detectors, machine vision television, ultrasonic detectors, and photo eye switches also can be used. These may advantageously be mounted above the worker so as to follow his movement around the chamber. When a worker is moving about in the booth, he will trip sensors which the controller will recognize as a predefined point signal. Upon recognizing the location, the controller will open the corresponding damper or dampers to create a flow of ventilation air through that location and, therefore, over and around the worker who tripped the sensor. By means of, for example, a software program, the controller will know the size and shape of the zone which is to be created in response to a given point signal. As the worker moves about the chamber, he continually generates new point signals. The controller instantly and smoothly responds to each signal by establishing a predetermined zone configuration corresponding to that particular point signal. The controller can be an industrial computer that activates relays that are connected to motor starters, solenoid valves, etc.

Whether the position sensor is of the manual or automatic type, it can provide either a single axis or a dual axis location signal. Preferably, the control means used with the automatic sensors will operate to ignore brief incursions into the sensor's area, e.q., by requiring that the occupant of that area of the chamber remain there for several seconds before a signal will be sent to open the exhaust damper for that area. Conversely, it is also desirable that the control means operate to ignore brief absences from an area for which the exhaust damper is open. These features serve to prevent the associated exhaust dampers from opening and closing if the worker enters—but then quickly leaves—an area served by an automatic position sensor. This is to prevent dampers from constantly opening and closing when someone is working at or near the margin of two automatic position sensor areas.

It also is preferred that the work chamber be equipped with means for regulating the volume of airflow through the work chamber in accordance with the number of exhaust dampers that are open. The smaller the ventilation zone, the lower the airflow rate that is needed. Means for controlling the rate include variable speed means for the exhaust and supply air fans and/or a modulating damper in the supply air conduit or the exhaust conduit, or both.

Mobile Zone System With Adjustable Partition With Air Opening

Instead of having an array of dampers to divide the exhaust face of the work chamber into sections, an adjustable partition, with an exhaust opening therein, can be used as a wall of the chamber. The partition should be parallel to the cross section of the chamber and must be adjustable so that the exhaust opening can be moved from side to side, so as to keep the opening opposite the worker at all times. In other words, the partition should be operable to move so as to reposition the opening in two directions along a path of movement that is substantially parallel to the cross section of the chamber. Except for the opening, the partition must be substantially impermeable to air.

Any of numerous different constructions can be used to make the partition adjustable. It may, for example, consist of flexible curtain members carried on (i.e., wound on) rollers. Or it may be an accordion wall comprising a foldable assembly of panels hinged together. Alternatively, the partition can be made up of parallel, overlapping, sliding panels that have air seals between them. The partition also can be a panel mounted on tracks that are recessed in the chamber's walls or that extend outside the chamber. In this embodiment the panel will preferably be flexible, for example like the sliding panel in a roll-top desk.

If the partition is comprised of curtain members carried on rollers, each roller can be either stationary or movable. If it is movable, the roller will be adjacent the opening through which the air flows. If the roller is stationary, it will be located at one of the two ends of the partition, for example mounted at an outside corner of the work chamber. The curtain members are mounted on tracks and preferably have air seals between the track and the curtain member. If stationary rollers are used, some drag will be experienced in pulling the curtain member along the track, due to the sliding action against the air seals. With movable rollers, however, the curtain member does not slide in its track, it is just picked up or paid out by the roller. Therefore, if the partition is extremely long, it may be preferred to use two movable rollers that frame the opening in the partition.

Such an adjustable partition can be used either at the exhaust face or the supply face, or both.

Mobile Zone System With Manned Movable Cab

Instead of an array of dampers, or a movable partition with an air opening, a mobile cab, operable to carry the worker from one location to another in the work chamber, and to hold the worker as he performs his work activity, may be used to confine the path of ventilating air through the chamber. The cab will have an open front and a rear portion. The chamber will include means for delivering the ventilating air to the cab from the rear. Preferably the cab will be in direct communication with an area exterior to the work chamber, thus allowing ingress and egress of the worker to and from the cab, without having to pass through any region of the work chamber that lies outside the ventilation zone.

In one such embodiment, the cab is connected by a flexible conduit to a source of ventilating air. The conduit, for example, may be an enclosed corridor extending from the rear of the cab to an area exterior to the work chamber. To provide mobility the corridor can be articulated. Alternatively, it can be a telescoping, enclosed walkway, in which case it preferably will be pivotably mounted to an opening in the wall of the chamber.

In a different embodiment, the cab constitutes an alcove in an adjustable partition at the supply face of the chamber. The construction of the partition can be the same as described above.

Movable Cab With Conduit to the Outside

When the fresh air confining means includes a movable cab inside the chamber, which is at the end of a conduit extending to the outside of the chamber, it is preferred that the chamber include means for air recirculation. Such a design represents as nearly a closed loop system as is currently practical. It is believed that it is the most efficient embodiment of the present invention. Of such designs, two categories exist. One features a fresh ventilating air component which flows through the cab in predominantly the same direction as the recirculated air. The other category features a fresh ventilating component which flows through the cab in predominantly a perpendicular direction to the recirculated air. It is important to note that operationally these two categories are equivalent in the most important respect, the area of work activity.

For both categories the movable cab should be far enough inside the chamber that it can be brought relatively close to the surface of the workpiece, in order that the fresh air emanating from the cab will impinge on the surface of the workpiece, typically in a perpendicular direction. In the case of spraying operations, the important activity is the transfer of coating material from the application tool to the workpiece surface. This important activity is aided by the design under discussion due to two features. First, the fresh ventilating air from the cab travels in the most advantageous direction, which is perpendicular to the work surface and parallel to the surface coating stream exiting the application tool. Secondly, the relative direction of the fresh ventilating air exiting the cab is constant with respect to the surface of the workpiece, regardless of the location of the movable cab within the larger, stationary work chamber. The recirculated air that is swept through the work chamber is for overspray control and does not take part in the transfer activity; therefore, its direction is largely irrelevant.

These two features of the present invention overcome an unavoidable fault in the design of both conventional and recirculation type ventilated paint booths. This fault is the disadvantageous interaction between the work activity and the ventilating air. The spray pattern of ballistically applied surface coatings is rather delicate. The pattern and transfer efficiency are upset by turbulence: specifically, cross drafts and eddies. These cross drafts and eddies are a natural occurrence in conventional and recirculation paint booths. For as the painter follows the contours of the workpiece, the relative direction of the spray stream constantly changes, unless the workpiece is completely planar and is to be coated only on one side. This problem is most acute on the lee side of the workpiece, where the workpiece substantially blocks the ventilating air, causing dead air spaces and eddies.

This turbulence, which increases with increasing ventilating velocity, puts an upper limit on the ventilating velocity which can be employed in a ventilated paint booth of conventional or recirculated design, even when a higher ventilating velocity would be advantageous. The design of the present invention need not suffer this limitation, since it can be substantially free from the cross drafts and eddies. Efforts of this nature typically result in improved coating quality.

With respect to the present invention, the primary purpose of the recirculated air in the larger, stationary work chamber is to provide positive particulate and fume protection. If the extra protection afforded by the recirculated air is not required, the recirculation feature can be deleted and additional expense saved. Several of the embodiments to be described herein include designs in which the recirculation feature is an independent circuit. Deletion of this circuit will not impair the operation of this invention. Since the fan means of the recirculated component and fresh component are independent, their velocities can be independently set to the most advantageous rate.

An added advantage of independent circuits is the ability to maintain the recirculation conduit at slightly less than atmospheric pressure. The benefit of this feature is that leakage, if it occurs, will be in the preferable direction of fresh air into the recirculation conduit, rather than the escape of contaminated air from the recirculation conduit into the surrounding work place.

Movable Cab As Alcove In Adjustable Supply Face Partition

A common surface coating operation utilizes a side draft booth in which the workpieces hang from an overhead conveyor. The workpieces are coated by the worker pacing back and forth as the workpieces are slowly conveyed through the booth.

Previously mentioned is the case where a zone of fresh air follows the worker as he paces back and forth in the work chamber. A further refinement includes the worker riding in this zone of fresh air. The motion of pacing back and forth can be replaced by a motorized platform which shuttles back and forth in the work chamber on tracks. The hoses normally dragged by the worker can be attached to the work platform and their weight borne by a festoon or reel system attached to the chamber, which will serve the control system as well. This frees the worker from the fatigue of pacing back and forth and the hindrance of dragging the hoses. Typically, efforts of this nature result in improved productivity.

Control of the movement of this mobile work platform may be manual, automatic, or a combination of both. Manual control may be accomplished by mounting a hand or foot operated joy stick on the mobile work platform or the previously mentioned control pendant. By deflecting the joy stick in one direction, motion of the work platform is established. The rate of motion may be proportional to the degree the joy stick is deflected. Automatic control may be accomplished by moving the work platform in a preprogrammed sequence with respect to direction and rate. Automatic control is most beneficial when the workpieces and work activity are regular and repetitive. The worker can be provided with additional control by a device on the work platform to start, stop, and initiate the preprogrammed movement.

For the worker to ride in a zone of fresh air requires that the mobile work platform be in the form of an open cab with a floor, walls and ceiling, also referred to as "the mobile work chamber". This cab defines the opening through which fresh air is delivered into the work chamber. In this example, the cab is an alcove in an adjustable partition at the supply face of the chamber. This partition preferably accomplishes the required back and forth motion by being constructed of one or more curtain members that alternately wind up and pay out from rollers, as described earlier herein. This assembly may be configured as two vertically disposed rollers, one at each side of the work chamber with a single curtain member stretched between. To move the partition, and the cab attached to it, the curtain member will wind up on one roller while paying out from the other. To change directions, the reverse procedure is applied.

Alternatively, two curtain members may be configured with the two vertically disposed rollers at each side of the cab. One end of each curtain member is attached to the chamber wall, while the other end is wound up on the roller. The important feature of this arrangement is that, as the cab moves, the curtain members wind up and pay out with no relative motion with respect to the track and seal. The benefit of this feature is a great reduction in friction from the contact of the curtain members and their horizonal seals. With an unusually wide partition, such friction can detrimentally affect smooth operation.

A further improvement in conveniently sealing the curtain type partition may be obtained by using idler rollers. The idler roller will solve the occasional sealing problem encountered due to the changing diameter of the curtain roller as the curtain member winds up and pays out from the roller. With this improvement, there will be one vertically disposed idler roller for each vertically disposed curtain roller and the idler roller will be located between the curtain roller and the vertical curtain seal.

The curtain member can be fabricated by a variety of materials and methods while still functioning as a flexible barrier. The common fabrications include a curtain made up of narrow interlocking steel slats and a curtain made of thin metal sheet with traverse reinforcements attached. For greater economy, the curtain member might be composed of fabric with traverse reinforcements. The reinforcements may be equipped with anti-friction bearings, or anti-friction bearings may be mounted to the track for the curtain member to bear against. Preferably, tensioning means will act upon the rollers, which in turn will keep the curtain member taut and free from slack, thereby promoting smooth operation.

To incorporate recirculation, a duplicate partition must be located in the chamber, interior to the first partition. Both partitions will move in unison. The chamber formed between these two adjustable partitions will receive the recirculated air from a duct that is supplied by fan means communicating with the exhaust chamber. The inner partition will be perforated to function as a diffuser to uniformly distribute the recirculated air. With careful sizing of the recirculating fan means and perforation size and spacing, the perforated inner partition can distribute the recirculated air uniformly, regardless of the cab (or alcove) position along the supply face of the work chamber. As a result, balancing valves in the recirculation duct may be dispensed with.

In this design, the entire cross section of the work chamber will preferably be swept with air. In the ventilation zone will be ventilating air, in the rest of the chamber will be primarily recirculated air. The fresh air will enter the work chamber primarily through the alcove in the pair of partitions, but some fresh air also will be pulled in through other openings in the work chamber, such as those for the entrance and exit of workpieces. If the ratio of recirculated air to fresh air is high, the overspray filter will commonly be a high efficiency, multistage, dry filter. High particulate removal efficiency is important to prevent the overspray from becoming a dust source in the recirculated air as it repeatedly passes over the workpiece. A dry filter, rather than a wet filter, is desirable to prevent an excessive increase in humidity in the recirculated air as it repeatedly passes through the filter.

As an example, for a side draft booth with a cross section 10 feet high by 15 feet wide, the total air flow would be 22,500 cubic feet per minute, based on 150 square feet of cross section at 150 feet per minute ventilating velocity. If only one painter at a time used this booth, then only one cab would be required. If the cab dimensions were 4 feet wide and 7 feet tall, then the fresh air flow would be 4,200 cubic feet per minute, based on 28 square feet of cross section at 150 feet per minute ventilating velocity. Thus, for the total air flow of 22,500 cubic feet per minute, the recirculated component will be 18,300 cubic feet per minute, with a fresh component of only 4,200 cubic feet per minute. As a result, with the present invention every minute 4,200 cubic feet of fresh air is introduced into the booth and the same amount of spent exhaust air is discharged to the atmosphere. This compares to 22,500 cubic feet per minute of air, which is required in a conventional booth in which there is no recirculation and the entire booth is constantly ventilated with fresh air. This represents an 81 percent reduction in the ventilating air required to safely and legally operate the booth under current regulations and standards.

Mobile Zone System with Recirculation—Perpendicular Components

Another design of the present invention includes a work chamber having a fresh air component and recirculated component operating in different directions. The down draft booth with an enclosed, articulated corridor is such an example.

Beginning with a conventional down draft booth comprised of supply, work, and exhaust chambers, the recirculation circuit is established by connecting the exhaust chamber to the supply chamber. In this way, air from the work chamber contaminated with particulates and fumes is drawn into the exhaust chamber, where the filter means remove the particulates. That which was formerly the exhaust fan means becomes the recirculation fan means. The recirculation fan means draw the particulate-free air from the exhaust chamber and push it into the supply chamber, which in turn distributes the recirculated air uniformly throughout the cross section of the work chamber. This completes the independent recirculation circuit.

In this design, one or more articulated corridors are attached to openings in the work chamber wall. At the other end of each articulated corridor, an open cab is attached which serves as a mobile work platform. The articulated corridor provides the passageway for the fresh air and the means for worker ingress and egress. Additionally, the articulated corridor provides the motive means to position the cab for suitable worker access to the workpiece. Other means may be combined with this articulated corridor to acquire whatever degree of freedom of movement is desired. Control of this movement is accomplished through said manual or automatic control means.

The cab on the end of the articulated corridor need not be permanently fixed. In fact for some types of workpieces, detachable cabs will be required. These detachable cabs will differ from one another in size, shape, and/or the orientation of the work face of the cab. Differences in the size of cabs may require an adjustment in the fresh air ventilating rate. This may be accomplished by adjustments to the independent exhaust supply means through the said control means. Each cab will be optimized to provide the best function or access to the surfaces of the workpiece. The detached cab may be stored on the floor or in a rack within the work chamber. The articulated corridor should be capable of maneuvering to drop off the current cab and pick up the next cab in a manner similar to the automatic tool changers on CNC machine tool centers.

Not all of the movement to gain access to the workpiece surface needs to come from the movable cab. Workpiece positioners capable of moving the workpiece back and forth, up, down, and in and out of the work chamber, as well as tilting and rotating the workpiece, may substitute for a portion of the movement which would otherwise be required of the articulated corridor. Taken to the extreme, in certain cases all the movement could be provided by the workpiece positioning means and the cab could be mounted directly over an opening in the work chamber wall. The disadvantage to this arrangement is the limitation of one worker per work piece. Control and coordination of the work piece positioner is accomplished by the said manual and automatic control means. For manual control, the control input devices should be located in the cab.

The rate at which air from the work chamber is exhausted to the atmosphere is equal to the rate at which fresh air is introduced into the work chamber through the confining means and any permanent openings in the work chamber walls (typically for work piece ingress and egress). The air entering through these openings will be drawn from the work chamber into the exhaust chamber and through the filter means. An equivalent amount of air will then be drawn from the exhaust chamber by the exhaust fan means and pushed out into the atmosphere through the exhaust stack. This completes the independent exhaust circuit.

As an example, for a down draft booth with a cross section 50 feet long by 50 feet wide, the total air flow through the work chamber would be 375,000 cubic feet per minute, based on 2500 square feet of cross section and 150 feet per minute ventilating velocity. Assuming two workers at a time use this booth, then one larger or two smaller confining means are required. If the opening in the said confining means, in this case the cab, is 4 feet wide by 7 feet tall, then the fresh air flow through the said confining means into the work chamber would be 8,400 cubic feet per minute. This rate is based on 28 square feet of cross section and 150 feet per minute ventilating velocity, times 2 confining means. Thus, for the total air flow through the work chamber of 375,000 cubic feet per minute, the recirculated component will be 366,600 cubic feet per minute, with a fresh component of 8,400 cubic feet per minute entering through the two articulated corridors with cabs. As a result, by the design of the present invention every minute 8,400 cubic feet of fresh air is introduced into the booth and the same amount of spent exhaust air is discharged to the atmosphere. This compares to 375,000 cubic feet per minute of air which is required in an equal size booth of conventional design. This represents a 97.6 percent reduction in the ventilating air required to safely and legally operate the booth under current regulations and standards.

The invention will be better understood by considering the drawings accompanying this specification.

Referring to the drawings,

FIG. 1 schematically illustrates in a sectional view a typical prior art form of large, elongated, enclosed paint spray booth, over which the booth described herein represents a distinct improvement.

Figure 1:
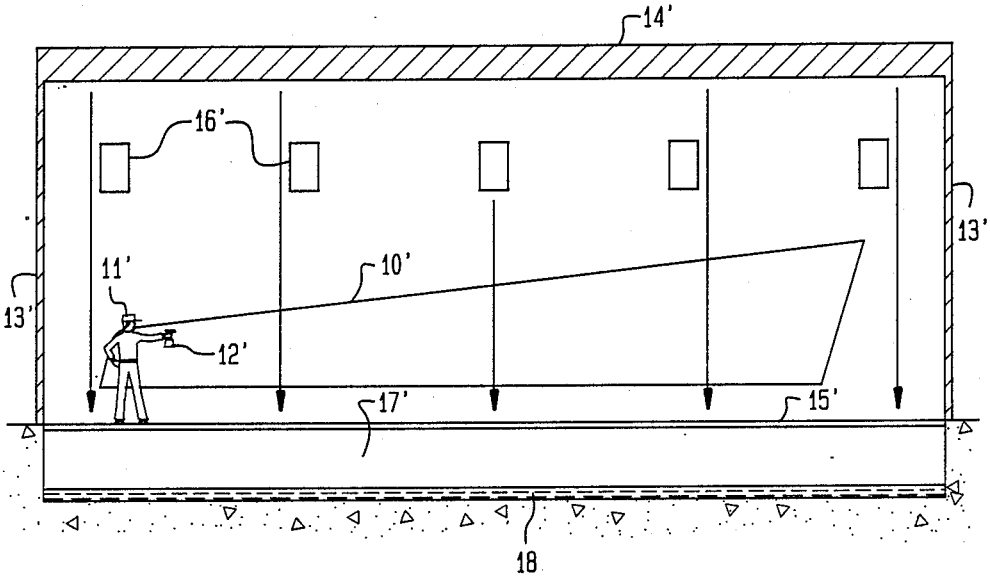
FIG. 1 (PRIOR ART)

As shown in FIG. 1, an airplane wing 10' is being painted by a workman 11' using a compressed air spray gun 12'. The operation is being performed in a typical enclosed prior art down draft booth, bounded by walls 13', ceiling 14', and floor grating 15'. The booth might measure, for example, 60 feet long, 20 feet wide, and 20 feet high. Electric lights 16' are mounted inside the booth. Beneath floor grating 15' is a basin-like chamber 17', which contains a shallow pool 18' of scrubbing water.

Ceiling 14' has one or more inlets (not shown) through which fresh air is supplied. The draft is created by a fan mounted in an exhaust stack (also not shown) which is in communication with sub-floor chamber 17'. The air entering the booth through ceiling 14' is pulled down through grating 15', across pool 18', and up and out the exhaust stack, where it is released to the atmosphere. Between the pool 18' and the exhaust stack is an exhaust chamber (not shown) in which the air is scrubbed with a recirculating stream of the water from pool 18'.

As illustrated in FIG. 1, even though the painter 11' is spraying in only a small region of the prior art booth at any one time, fresh air continuously is being swept through all regions of the booth. In such a booth the air flow rate may have to be set at about 150,000 cubic feet per minute (cfm) to provide adequate ventilation and control of overspray.

Figure 2:
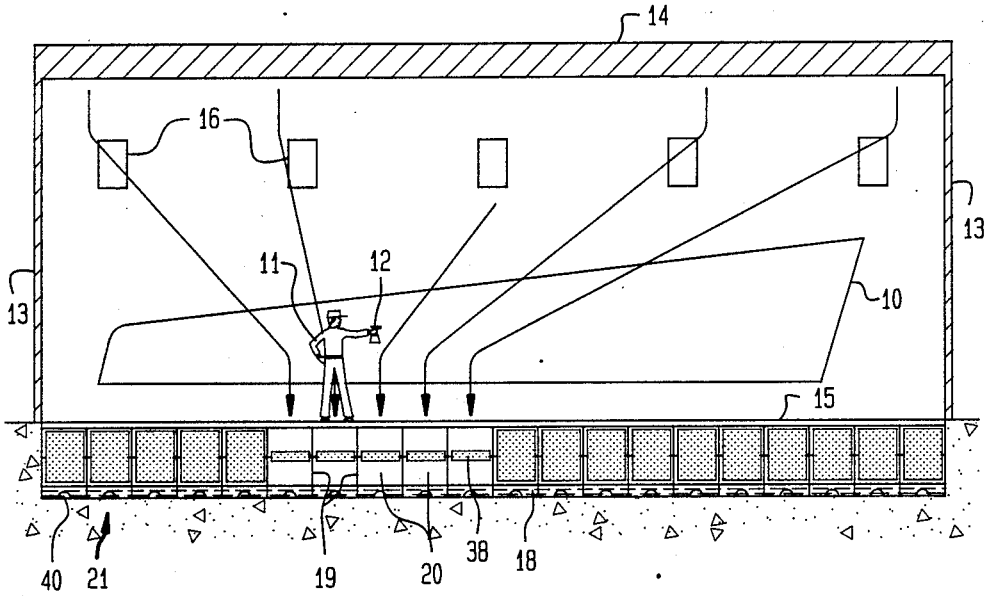
FIG. 2 is a schematic, sectional representation of the booth of the present invention.

FIG. 2 represents the same paint spray booth as in FIG. 1, but modified according to the present invention. The sub-floor chamber is divided by solid vertical partitions 19 into twenty, parallel, open-top channels 20, which extend the full width of the booth. The partitions may advantageously be constructed of concrete, metal, or fiberglass. The near end of each channel 20 is filled with a single-blade, rectangular, butterfly-style damper 21. Counting from the left, the first five dampers (Nos 1–5) are shown in the closed position, the second five (Nos. 6–10) are shown fully open, and the last ten (Nos. 11–20) are shown closed. Spray gun 12 is located over the channel controlled by the middle open damper (No. 8). Signal-generating means (not shown) generate a signal indicating the painter's location in the booth. In response to the signal, the damper control system (not shown) automatically opens the damper controlling the channel directly below the painter, plus the two dampers to the left and right thereof. The remaining dampers are held closed.

Because only damper Nos. 6–10 are open, all of the air being swept through the booth is exhausted through an opening that is only one-fourth the entire floor area of the booth. Ventilation is therefore localized around the workman 11. For adequate ventilation and overspray control, the air flow rate through the booth need only be set at about 35,000 cfm.

Figure 3:
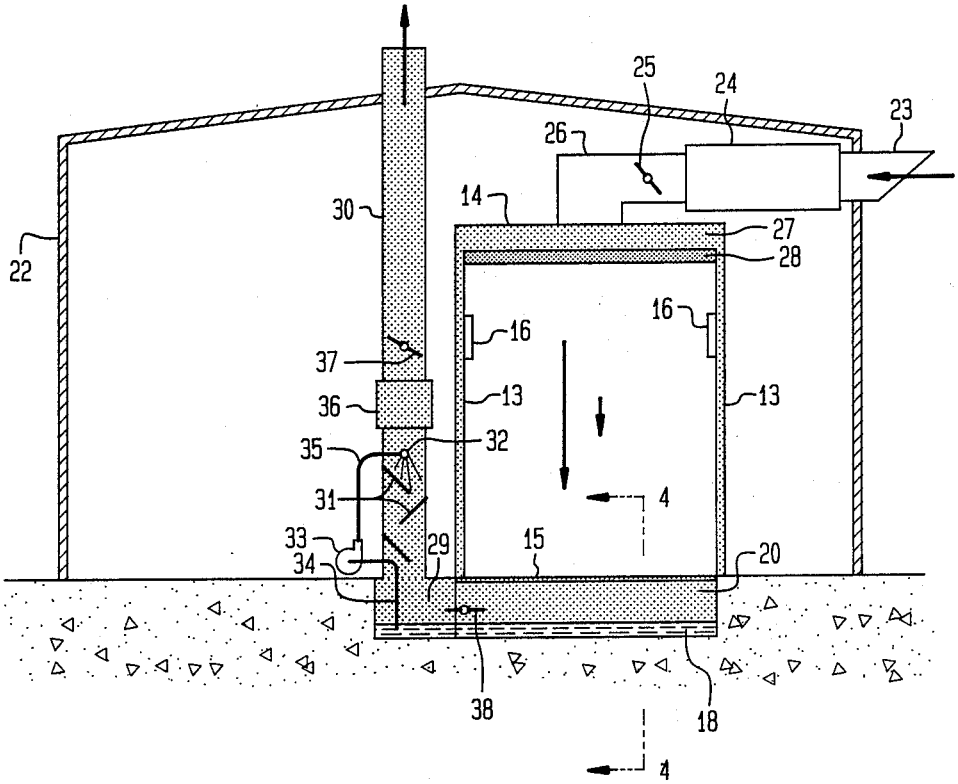
FIG. 3 is an end sectional view of the booth depicted in FIG. 2, additionally showing the paint building in which the booth is housed and other details and apparatus.

FIG. 3 is an end view of the booth depicted in FIG. 2, together with various associated equipment, but without showing the wing, workman, or paint gun. As seen in FIG. 3, the booth is housed in a paint building 22. Fresh air enters the building through duct 23 and passes through a gas-fired heater 24. Heater 24 is operated only when outside air temperatures are low enough that the air needs to be heated for worker comfort and to achieve adequate drying times. The volume of the airflow is controlled by a modulator damper 25 mounted in duct 26, leading from heater 24. Fresh, or make-up, air enters the plenum space 27 of the paint booth and passes through filter 28, which, for example, may be made of disposable fiberglass pads. Filter 28 covers substantially the entire ceiling area of the booth. The filtered air is drawn down through the grating 15, into channel Nos. 6–11 (see FIGS. 2 and 4) and through the open dampers. Some of the paint particles in the air settle into the water pool 18.

After passing through those dampers 21 which are open, the air is drawn through L-shaped outer exhaust chamber 29 and up and out exhaust stack 30. In the upper region of outer exhaust chamber 29 are mounted baffles 31 and a spray head 32. Outer exhaust chamber 29, together with baffles 31 and spray head 32, runs the entire length of the row of dampers 21. Water from pool 18 is drawn by pump 33 through line 34 and delivered via line 35 to spray head 32 to thoroughly wash the air before it is vented through stack 30 to the atmosphere. The rate of airflow can be controlled by an adjustable speed fan 36 or by a modulating air flow damper 37.

Figure 4:
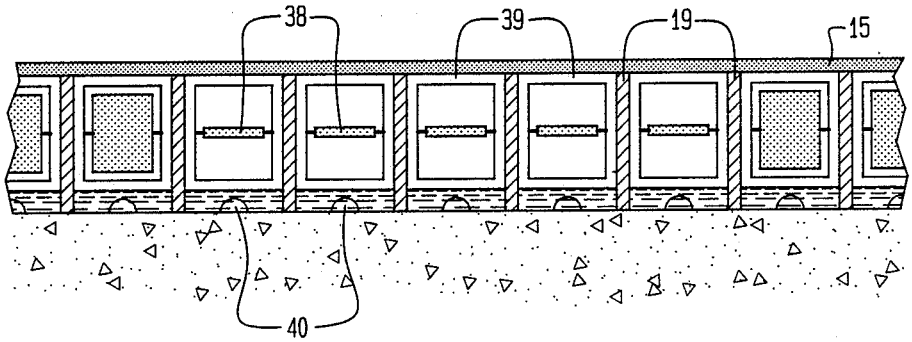
FIG. 4 is an enlarged sectional view, taken along the line 4—4 in FIG. 3, of a segment of the row of dampers illustrated in FIGS. 2 and 3.

FIG. 4, because it is an enlarged, segmented view, shows only damper Nos. 4–10 completely. As seen in FIG. 4, each damper comprises a pivotably mounted blade 38, carried by a frame 39. Each blade is driven by a pneumatic actuator (not shown). Frame 39 fills the opening between the partitions 19. Blade 38 is slightly smaller than the opening in frame 39, leaving a gap of approximately one-half inch between all four edges of the blade and the frame. There is no seat for the blade to rest against when in the closed position.

Each frame 39 has a semi-circular bottom cut-out 40 to allow the circulation of scrubbing water between the channels 20 and the outer chamber 29. The level of the water pool 18 is kept high enough to submerge all of the cut-outs 40, thus creating a seal against the passage of air through or around any closed dampers. The height of pool 18 is below the bottoms of blades 38, however, so as not to interfere with the movement of the blades.

The cost of equipping a booth with the mobile zone equipment of the present invention can be made up many times over by the savings realized in electricity to run the booth fan, in natural gas to heat the air, and in downsizing the EPA control equipment. For example, the down draft paint booth depicted in FIG. 1, if used 3 shifts per day, 5 days per week, in Nashville, Tennessee, will use approximately $85,000 of electricity and natural gas every year, mostly for heating. By reducing the air flow to 35,000 cfm by means of the mobile zone equipment shown in FIGS. 2–4, the same booth will only use about $19,900 of electricity and natural gas per year. This represents a savings of approximately $65,000 per year. For a paint booth located in a more northerly climate, with a longer and colder winter, the savings will be dramatically greater.

If the EPA requires the paint booth operator to add VOC emission control equipment (regenerative thermal or carbon adsorption), the 150,000 cfm paint booth will require approximately $2,700,000 worth of control equipment and will use approximately $300,000 of electricity and natural gas per year. By reducing the air flow to approximately 35,000 cfm by means of the mobile zone equipment of the present invention, the same booth will only require approximately $630,000 worth of control equipment and use only about $70,000 of electricity and natural gas per year. This represents a capital cost savings of approximately $2,070,000 and operating cost savings of approximately $230,000 per year.

Figure 5:
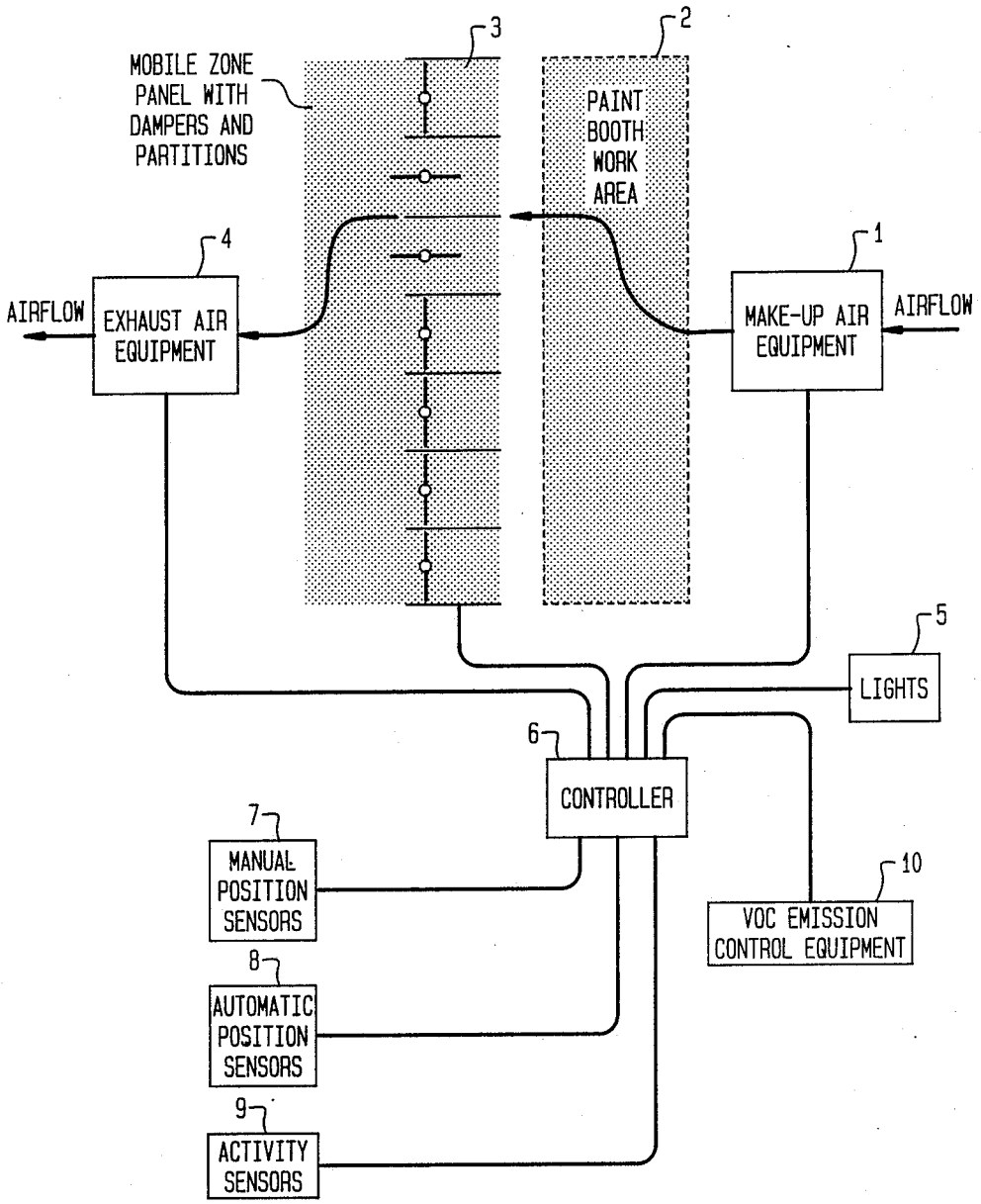
FIG. 5 is a schematic diagram of the control system for the booth depicted in FIGS. 2 through 4.

FIG. 5 is a schematic illustration of a control system for a paint booth of the present invention.

Referring to block 1, supply air enters the booth through make-up air equipment. This equipment is generally comprised of one or more units of ventilator fans, make-up air heaters, air conditioners, humidifiers, and filters, in various combinations. Control over the flow of air through this equipment is accomplished by a fixed or actuated damper, varying the fan rpm, varying the pitch of the fan blades, or selectively turning off units in a multiple unit installation. Depending on circumstances, a combination of actions may be required.

Referring to block 2, the work chamber of the paint booth is unaltered over the prior art. In most booths, however, there is a large quantity of air which is wasted. This air is too far from the generation of paint particles and vapors to do any useful work. In the present booth, a draft of air is maintained over the painting operation as always. The difference is that the areas of the booth too remote from the painting activity to have any effect thereon will have little or no air draft.

Referring to block 3, the mobile zone equipment consists of a panel located between the painting operation and the exhaust equipment. This panel contains one or more openings which are fitted with actuated dampers operated by a controller. If all the dampers in the panel are closed, the air will be blocked from entering the exhaust equipment. In practice, this means an array of dampers mounted in a panel; the dampers will be selectively opened in groups to force a particular air flow path. In addition, partitions may be fitted to the panel to further define an air flow path. By selectively opening and closing the dampers, a mobile zone or zones can be created which can follow the painting operation as it moves around within the confines of the booth. The size and shape of the mobile zone will be adjustable through programming of the controller.

Referring to block 4, the exhaust air equipment will be comprised of one or more fans. Control over the flow of air from this equipment is accomplished by a fixed or actuated damper, varying the fan rpm, varying the pitch of the fan blades, or selectively turning off units in a multiple unit installation. Again, depending on circumstances, a combination of actions may be required.

Block 5 represents the lighting equipment in the booth. This lighting will be controlled in conjunction with the staged booth activity to minimize energy consumption.

Block 6 represents the controller and is a programmable device. It will accept input from the sensors and make the appropriate adjustments to the make-up air equipment, zone equipment, and exhaust equipment. This includes regulating the supply air, regulating the exhaust air, manipulating the zone, and optionally controlling the VOC emission control equipment.

Block 7 represents the manual location sensors. These may be portable control pendants or stationary switches which the operator manipulates to control the zone and booth activity level and may be electrical and/or pneumatic devices.

Block 8 represents the automatic location sensors. These sensors detect the location of the painter so that the controller can adjust the zone accordingly. These sensors may be, for example, pressure mat, ultrasonic, machine vision television, infrared, or photo eye switch sensors.

Block 9 represents the activity sensors. These sensors detect the flow or usage of compressed air and/or paint. Flow of compressed air or paint is evidence that painting operations are taking place. The controller has the capability of operating the booth at three levels of activity. For instance, when the painting is underway the booth will operate normally. However, if painting has stopped for a period of time, the controller will turn off some of the lights and reduce the air flow through the booth to a minimum level sufficient for vapor removal. If painting has stopped for an even longer period of time, the controller will shut off all air flow and maintain a minimum level of lighting.

Block 10 represents afterfilter equipment which is used to remove all the overspray and most of the volatile organic compounds from the exhaust air stream. This equipment is generally either a carbon adsorption unit or a regenerative thermal incinerator unit. Normally this equipment is only installed if required by the Environmental Protection Agency, due to its extreme cost.

Figure 6:
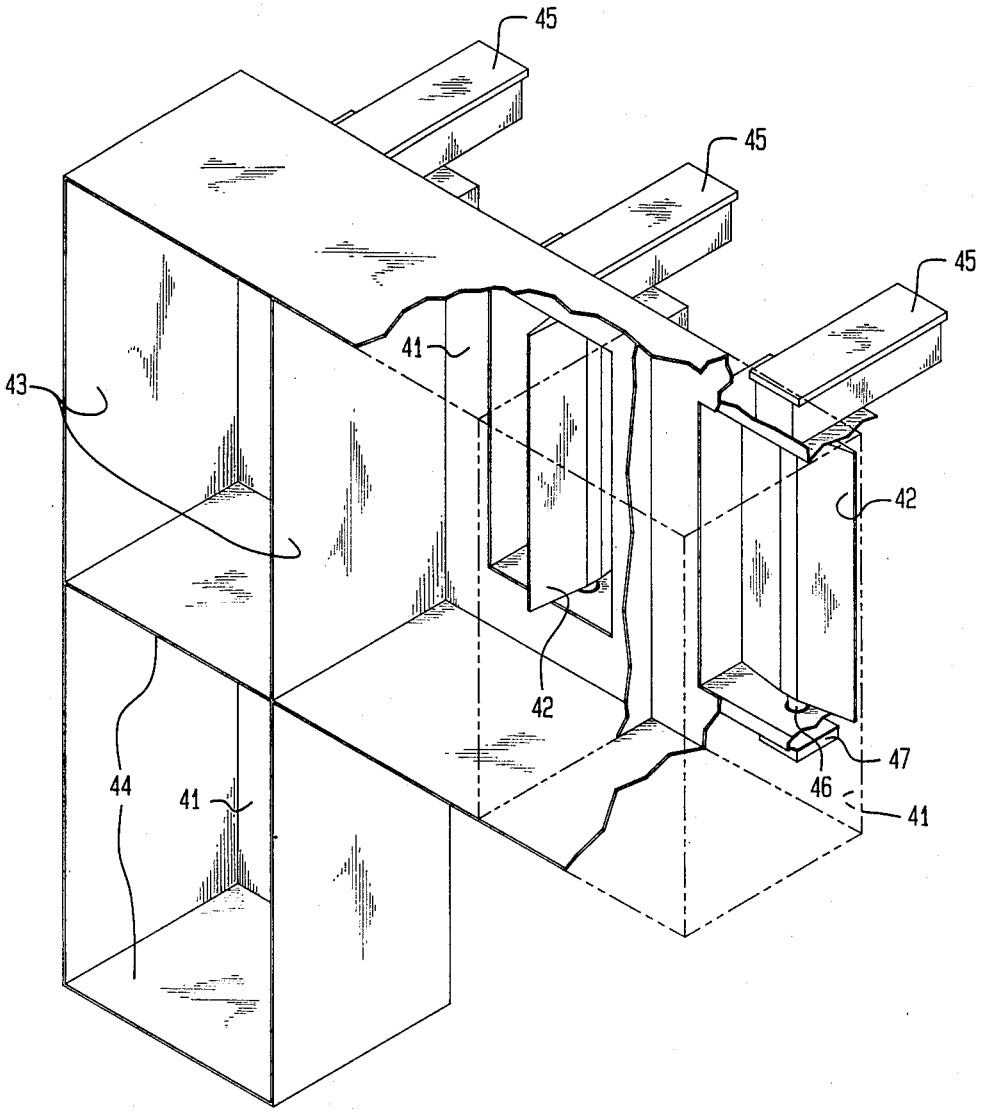
FIG. 6 is a schematic isometric view of a segment of a multi-row damper panel (partially broken away) for use in a tall side draft paint booth equipped with the improvement of the present invention.

FIG. 6 illustrates means by which either the exhaust air chamber or the supply air chamber can be subdivided both vertically and horizontally. For ease of illustration, only four sections are shown. Each section comprises a damper frame 41 in which a damper blade 42 is pivotably mounted about a vertical axis. As shown in the FIG. 6, the second damper from the left, top row, is open, while the damper to the right of that is closed. Vertical partitions 43 and horizontal partitions 44 isolate each damper from the rest. Partitions 43 and 44 extend from the damper frames 41 to the exhaust face (not shown) of the work chamber or, if the dampers are used in the supply chamber, to the supply face of the work chamber. The actuator (not shown) for each damper is contained in an air purged housing 45 atop the frame 41. The lower end of the shaft 4 of blade 42 is journaled in a bearing (not shown) that likewise is contained in an air-purged housing 47.

The arrangement shown in FIG. 6 might be used in both the supply and exhaust air chambers of a very large side draft spray booth, e.g., one in which both the supply face and the exhaust face measure; say, 200 feet long by 40 feet high. In such an arrangement each chamber may be divided, for example, into 4 rows of 50 such dampers. Any number of damper blades 42 can be open at any one time, thus allowing the cross-chamber ventilation zone to be adjusted vertically as well as horizontally.

Figure 7:
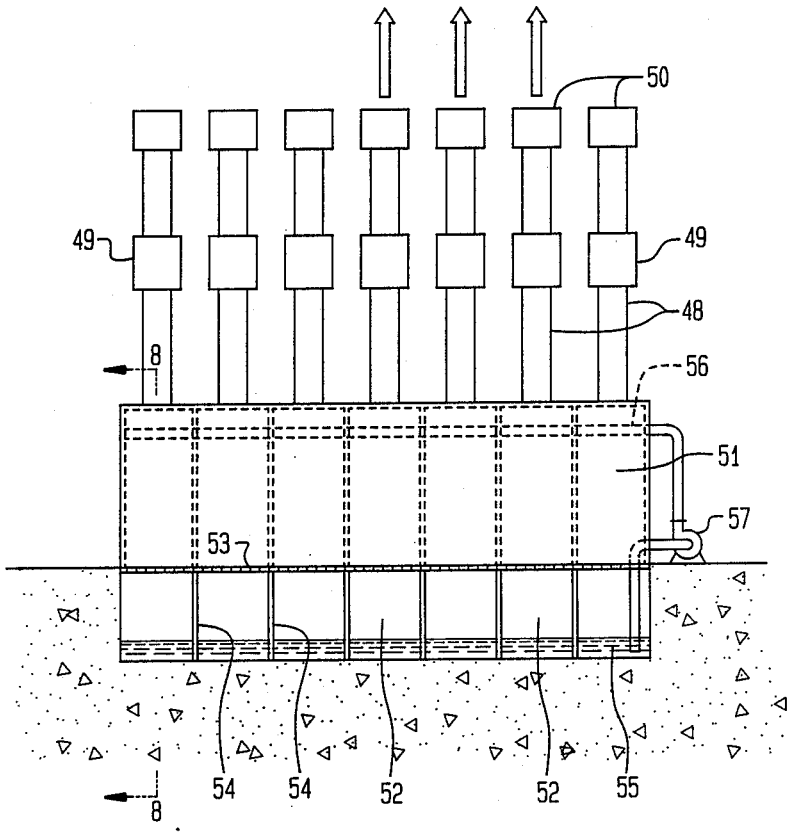
FIG. 7 is a schematic depiction of a different embodiment of the present invention in a down draft spray booth.
Figure 8:
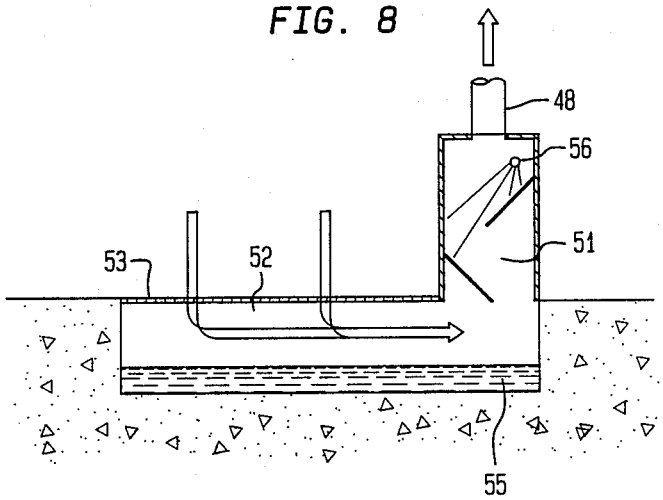
FIG. 8 is an end sectional view of the booth depicted in FIG. 7.

The down draft booth depicted in FIGS. 7 and 8 has a separate exhaust stack 48 for each zone of the booth. A ventilation fan 49 is mounted midway up each stack, and a backdraft damper 50 is mounted at the top. Below each stack 48 is a scrubbing chamber 51 that is in communication with a channel 52 that runs underneath the floor grate 53 in the work chamber. The other walls and ceiling that bound the work chamber are not shown. The channels 52 and scrubbing chambers 51 are separated by vertical, L-shaped partitions 54. The work chamber is thus divisible into seven ventilation zones. Air flow through these zones is controlled by turning various fans 49 on or off. Each fan controls one of the seven zones. When the fan is activated, the backdraft damper 50 is forced open, allowing the exhaust air to exit stack 48. Each channel 52 contains a pool of water 55 which is continuously recirculated through the sprayer 56 by pump 57.

Figure 9:
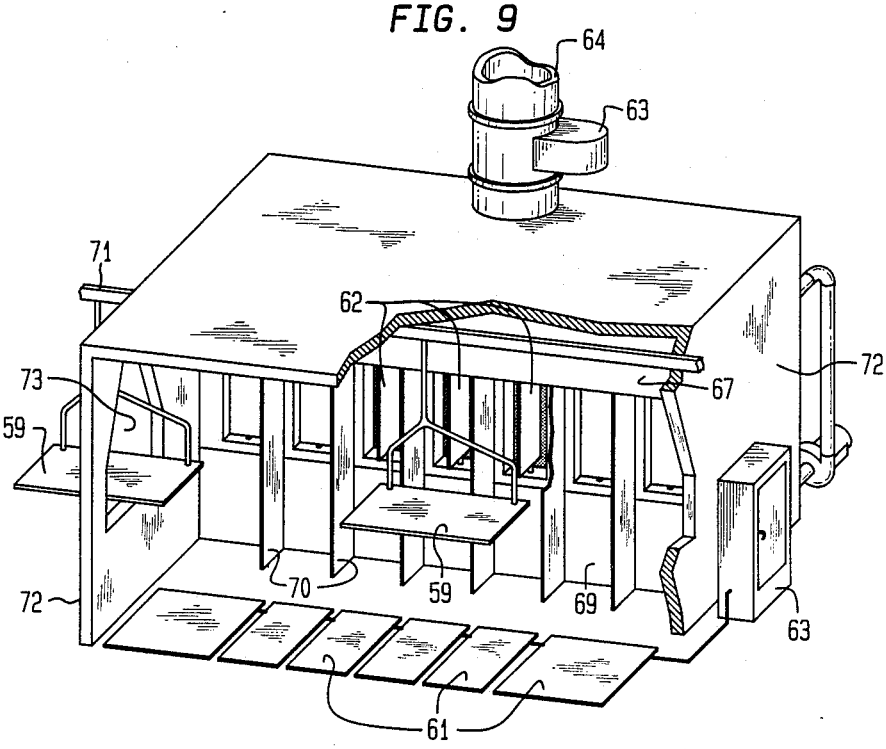
FIG. 9 is an isometric view of a semi-enclosed spray booth of the side draft type, also equipped with the improvement of the present invention.
Figure 10:
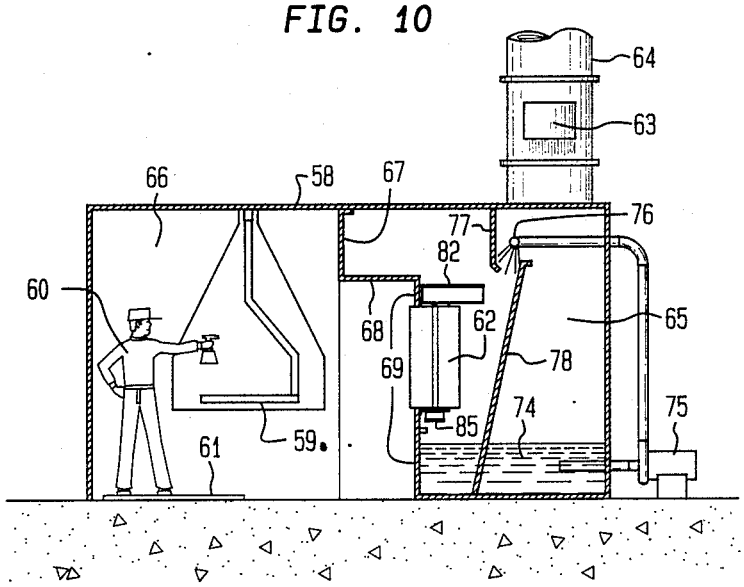
FIG. 10 is an end sectional view of the booth depicted in FIG. 9.

In FIGS. 9–13 is depicted a conveyorized spray booth of the present invention, also having seven ventilation zones. Suspended from ceiling 58 are monorail conveyor trays 59 that slowly transport the objects to be painted (not shown) through the booth. Monorail 71 extends through the booth. Booth end walls 72 have openings 73 for the passage of conveyor trays 59. The painter 60 (shown only in FIG. 10) walks back and forth on a row of six rectangular pressure mats 61 that extend the full length of the booth. Each mat is operable to activate a switch (not shown) when the mat is stood upon. As seen in FIG. 9, each mat 61 straddles the zones in front of two adjacent dampers 62. Controller means 63 operate to open the opposite pair of dampers whenever one of the mat switches is activated. If a wider ventilation zone is desired, the controller can be programmed to open not only the opposite two dampers but also the two immediately adjacent dampers as well. As shown in FIG. 9, the three center dampers are open, which would be the case if the painter had his left foot on the third pressure mat (counting from the left) and his right foot on the fourth pressure mat.

The paint-laden exhaust air is drawn through the open dampers 62 by a ventilation fan 63 to exit to the atmosphere through the exhaust stack 64. Each damper blade 80 is slightly smaller than the opening in the frame 79 in which it is mounted, to provide a certain amount of leakage through the damper when in the closed position.

The exhaust chamber 65 of the booth is separated from the work chamber 66 by upper wall portion 67, soffit 68, and lower wall portion 69. The exhaust face of the work chamber is the plane of the upper wall portion 67. Vertical partitions 70 extend from lower wall portion 69 to the exhaust face.

A pool of scrubbing water 74 stands in exhaust chamber 65. The water is recirculated by pump 75 to sprayer 76. The spray constantly wets baffles 77 and 78, which extend the entire length of exhaust chamber 65. Openings (not shown) near the bottom of baffle 78 allow water 74 to stand at the same level throughout exhaust chamber 65.

Figure 13:
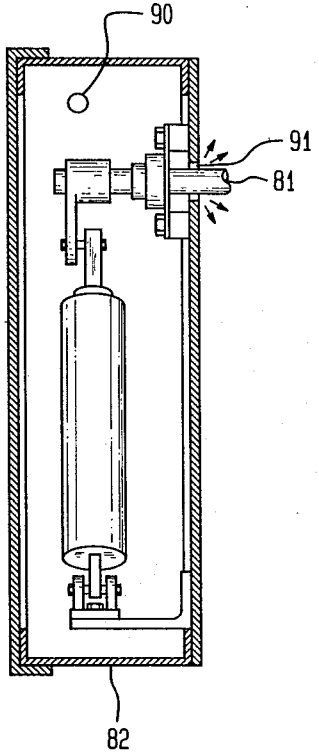
FIG. 13 is an enlarged view (partially broken away) of just the actuator and bearing assembly and housing as shown in FIGS. 10 through 12.
Figure 12:
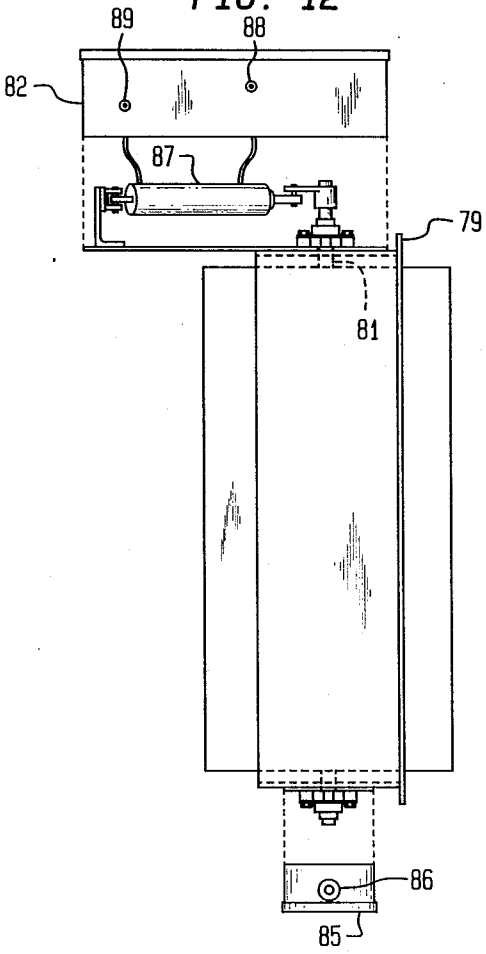
FIG. 12 is a side view of the damper depicted in FIG. 11.
Figure 11:
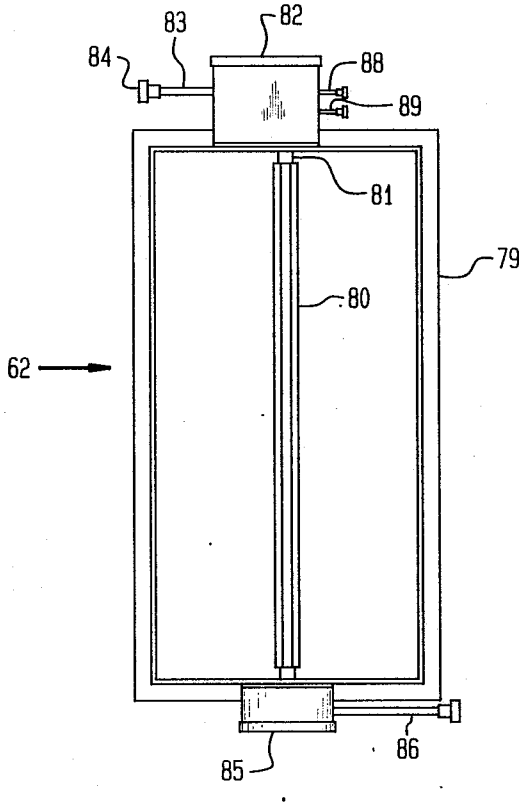
FIG. 11 is an enlarged front view of one of the dampers depicted in FIG. 9 and 10.

As illustrated in FIGS. 11 through 13, each damper is comprised of a frame 79 in which is mounted a blade 80 on a vertical shaft 81. Bearing and actuator housing 82 is constantly purged with air from compressed air line 83, which is fitted with a quick-connect coupling 84. Lower bearing housing 85 similarly is purged with air from line 86. Pneumatically-driven actuator 87 (shown in FIGS. 12 and 13) turns blade shaft 81. Two compressed air lines 88 and 89 provide the driving force for actuator 87. As illustrated in FIG. 13, purge air supplied by line 83 enters housing 82 through orifice 90 and constantly escapes through shaft hole 91. The purpose of the air purging is to prevent airborne paint particles from entering housings 82 or 85 and fouling the shaft bearings or actuator.

Figure 14:
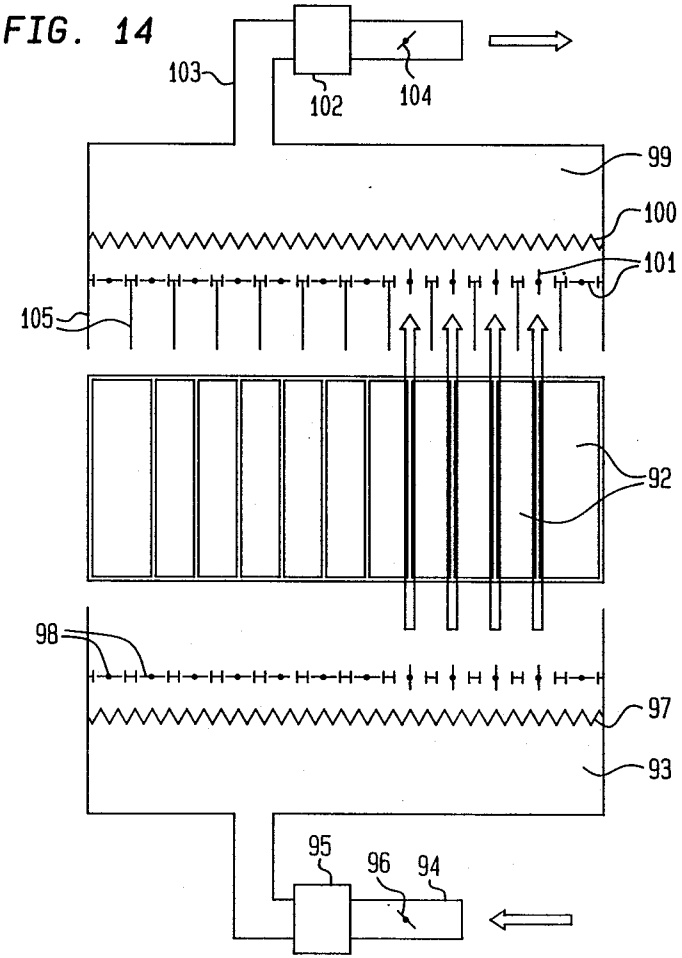
FIG. 14 is a schematic plan view of a side draft paint booth of the present invention in which both the supply face and the exhaust face are partitioned.

FIG. 14 illustrates schematically a side draft paint booth of the present invention having eleven pressure mats 92 on the floor of the work chamber. Fresh air enters air supply chamber 93 through conduit 94. A fan and air conditioning equipment (not shown) are contained in housing 95. The volume of air entering conduit 94 is controlled by flow control damper 96.

Filter 97 removes dust particles from the supply air. A row of twelve dampers 98 separates supply air chamber 93 from the work chamber at the plane of the supply face. Exhaust chamber 99 has a filter 100 and a corresponding row of dampers 101. Each exhaust damper 101 is isolated from the others by vertical partitions 10 that extend all the way to the exhaust face of the work chamber. As illustrated in FIG. 14, four of the supply dampers 98 and four exhaust dampers 101 are open, due to activation of the third pressure mat from the right. The activation of a single pressure mat 92 is recognized as a location signal by the controller (not shown). In response thereto the controller operates the appropriate group of predefined dampers. In this example the four dampers opposite the mat are opened automatically. Should two adjacent pressure mats be activated, the zone will expand to a width of five dampers. Each pressure mat 92 also opens the four supply dampers 98 that stand directly opposite the opened exhaust dampers 101. As shown in FIG. 14, then, ventilation is confined to approximately one-third of the work chamber. The exhaust fan (not shown) is mounted in housing 102. Exhaust air exits chamber 99 through conduit 103 and flow control damper 104.

Figure 15:
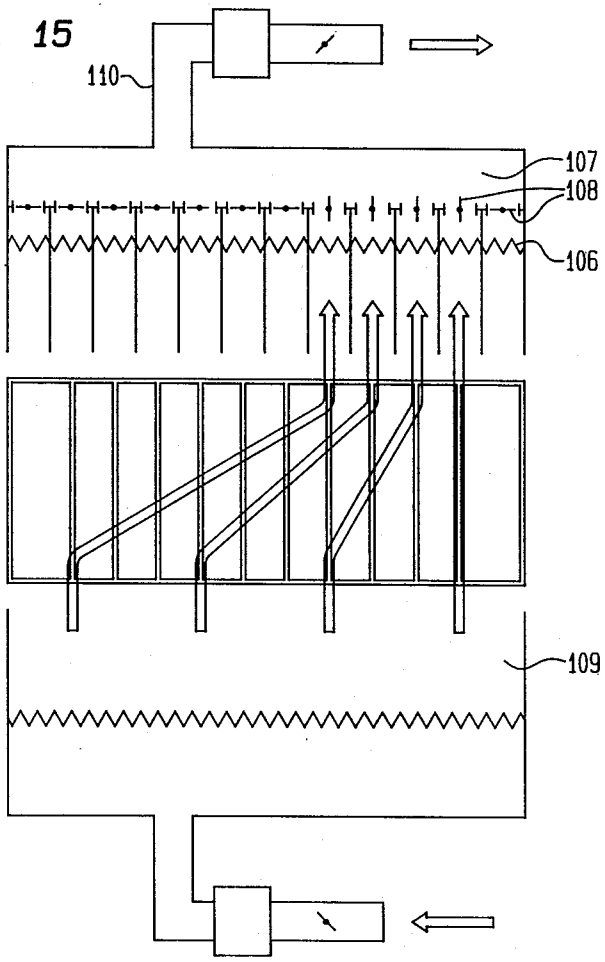
FIG. 15 is a schematic plan view of a side draft paint booth of the present invention in which only the exhaust face is partitioned.

In FIG. 15 is illustrated schematically a side draft paint booth of the same capacity as that shown in FIG. 14, but with only the exhaust face partitioned. Also, in the design shown in FIG. 15 the filter 106 in exhaust chamber 107 is located in front of the row of dampers 108. The result of having only the exhaust face partitioned is that the ventilation zone is not so strictly defined as in the apparatus depicted in FIG. 14. Still, the booth can be operated with a substantially lower rate of air flow through the exhaust conduit 110 than if neither the supply air chamber 109 nor the exhaust chamber 107 were partitioned.

FIGS. 16, 17, 18, 19, 20, 21, 22, 23, 24 and 25 illustrate alternative means of confining a zone of ventilating air and providing the zone with movement. The figures do not show weather stripping material used to provide a seal between the moving elements and the stationary elements. Also not shown are the tracks and wheels required for a smoothly functioning mechanism.

Since the confining means may be located in the work chamber, supply chamber or exhaust chamber, for these figures they will be referred to as chamber walls. The moving surface containing the opening will either be substantially impervious to the flow of air or it will be perforated to allow the flow of air. As shown, the openings in the confining means are rigidly framed. This is typical since the frame will often times bear the weight of a cab and serve as an attachment point for the wheels in a wheel and track system. As shown, the zone is capable of moving in one direction and then another. The motive means include manual, mechanized and automated. The motive means for this movement will typically be a powered mechanical drive such as a wheel, gear, chain, belt or cable drive powered by a motor of the electrical, hydraulic or compressed air type. Alternatively, movement may be provided by an empowered actuator such as a hydraulic or compressed air cylinder or ball screw. The powered motive means will be responsive to manual control inputs by the operator (switches and valves) and automated control inputs (automatic location sensors and preprogrammed sequence). Also not shown are encoding means to provide actual opening position feedback signal to the controller.

Figure 20:
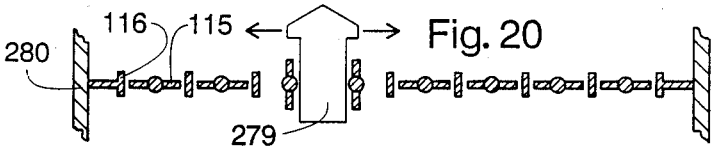

These alternative confining means may be combined to create confining means which achieve movement in more than one axis. This combined movement may be polar, cartesian or a combination of the two. The alternative confining means and combined confining means are also referred to as "curtain wall", "curtain panel", "panel" and "articulated corridor". The confining means of FIG. 20 is referred to as a "damper panel". It cannot be readily combined with the other alternative confining means since its opening is of the virtual type.

Figure 16:
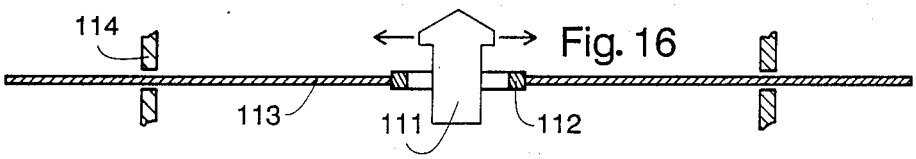
FIGS. 16–25 are schematic plan views of ten alternative means for confining the zone of fresh ventilating air that is pulled or pushed through a supply face into the work chamber of the present invention.

FIG. 16 illustrates a panel in sectional plan view whose confining surface 113 moves in a sliding manner. The opening in surface 113 is defined by frame 112, through which fresh ventilating air 111 passes. The chamber walls 114 provide the conventional confinement. Although in this case panel surface 113 pierces the chamber wall, the panel surface could just as easily extend into a pocket formed by the chamber wall 114, such as shown in FIG. 18.

Figure 17:
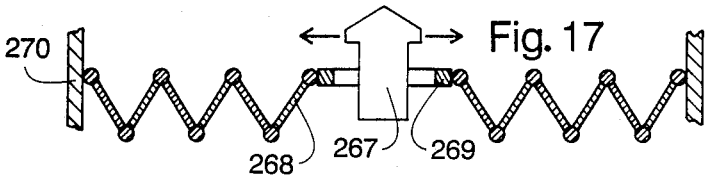

FIG. 17 illustrates a panel in sectional plan view whose confining surface 268 moves in a folding manner. The opening in surface 268 is defined by frame 269, through which fresh ventilating air 267 passes. The chamber walls 270 provide the conventional confinement.

Figure 18:
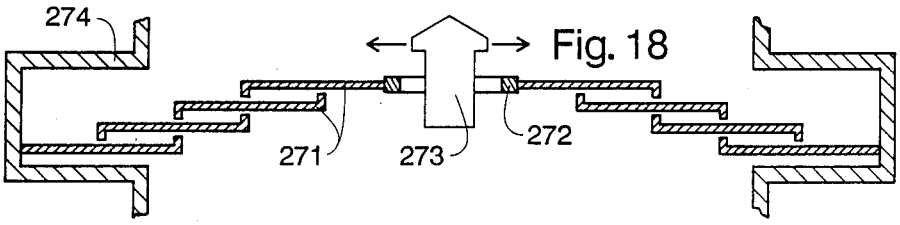

FIG. 18 illustrates a panel in sectional plan view whose confining surface 271 moves in a telescoping manner. The opening in surface 271 is defined by frame 272, through which fresh ventilating air 273 passes. The chamber walls 274 provide the conventional confinement. The pocket formed by chamber walls 274 is not essential to the operation of the panel; rather, the pocket provides additional unencumbered movement.

Figure 19:
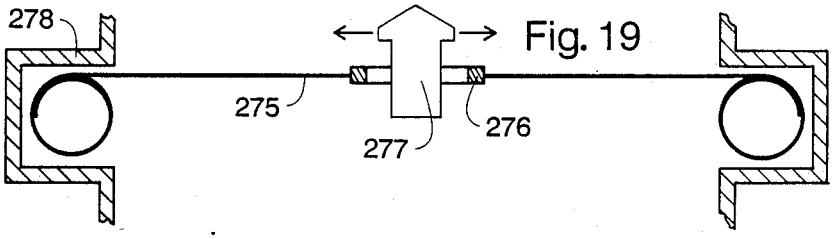

FIG. 19 illustrates a panel in sectional plan view, whose confining surface 275 moves in a spooling manner. The opening is moved by winding up the surface 275 on one spool while paying it out from the other spool. The opening in surface 275 is defined by frame 276 through which fresh ventilating air 277 passes. The chamber walls 278 provide conventional confinement.

FIG. 20 illustrates a panel in sectional plan view whose confining surface 115 moves in a damper manner. Ventilating air 279 passes through an opening created by opening one or more dampers 115 in the panel frame 116. The chamber walls 280 provide the conventional confinement. It is worth mentioning that while the opening in the panel readily permits the passage of air, it does not typically permit the passage of the worker(s), tools and supplies. On the other hand, the panels in FIGS. 16, 17, 18, 19, 21, 22, 23, 24, and 25 typically permit the unencumbered passage of worker(s), tools and supplies through their openings.

Figure 21:
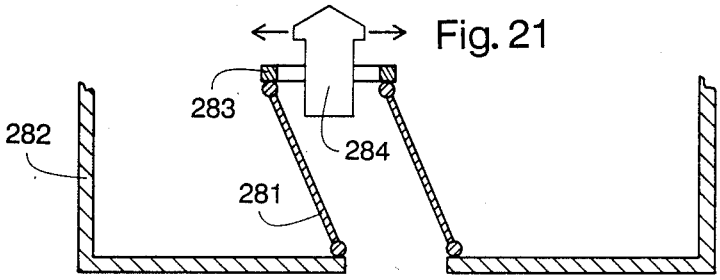

FIG. 21 illustrates a panel in sectional plan view whose confining surface 281 moves in a nozzle-like manner. The opening is moved by pivoting surface 281 at the chamber walls 282 and at the frame 283. The opening in surface 281 is defined by frame 283, through which fresh ventilating air 284 passes. The chamber walls 282 provide conventional confinement.

Figure 22:
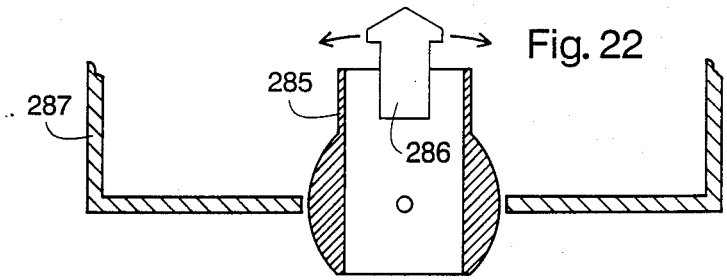

FIG. 22 illustrates a panel in sectional plan view whose confining surface 285 moves in a swiveling manner. The fresh ventilating air 286 passes through the opening in surface 285. The chamber walls 287 provide conventional confinement. As shown, the joint swivels about a central pivot point. Not shown is a variation in which the joint swivels about a pivot point located on a side similar to a hinge.

Figure 23:
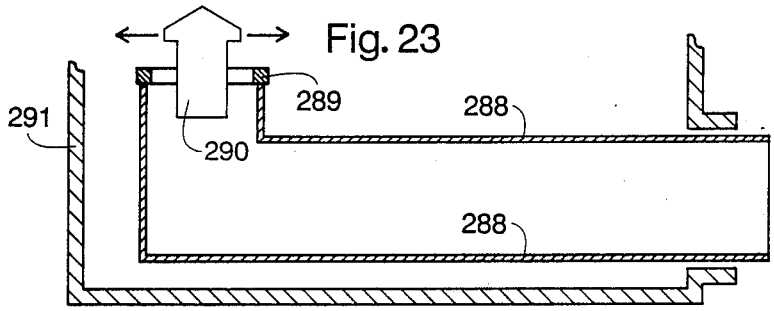

FIG. 23 illustrates a panel in sectional plan view whose confining surface 288 moves in a retracting and extending manner. The opening in surface 288 is defined by frame 289, through which fresh ventilating air 290 passes. The chamber walls 291 provide the conventional confinement. It is worth pointing out that this extension/retraction panel is really a variation of the sliding panel of FIG. 16. If the moving surfaces 113 of FIG. 16 are folded, the design of FIG. 23 is achieved. This folding is particularly convenient to accomplish on the confining means illustrated in FIGS. 17, 18, 19 and 24.

Figure 24:
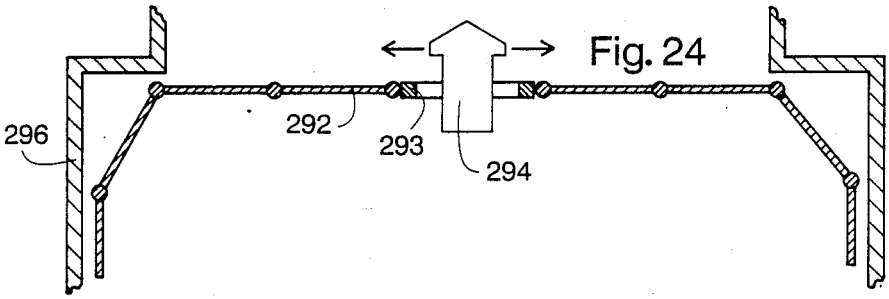

FIG. 24 illustrates a panel in sectional plan view whose confining surface 292 moves in a rotational manner. As shown, the surface 292 has multiple jointed segments. Not shown is the track which these segments follow as surface 292 moves. The opening in surface 292 is defined by frame 293, through which fresh ventilating air 294 passes. The chamber walls 296 provide the conventional confinement.

Figure 25:
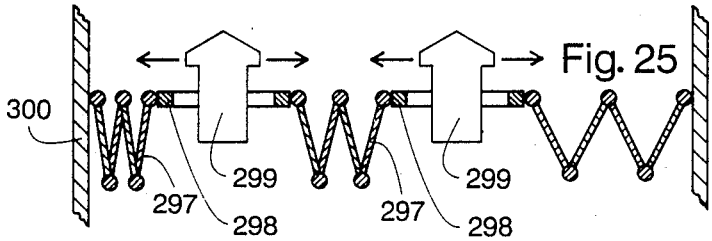

FIG. 25 illustrates a panel in sectional plan view whose confining surface 297 moves in a folding manner. The two openings in surface 297 are defined by frames 298, through which fresh ventilating air 299 passes. This figure is an example of how multiple zones of fresh ventilating air 299 can be created. The chamber walls 300 provide the conventional confinement.

Figure 26:
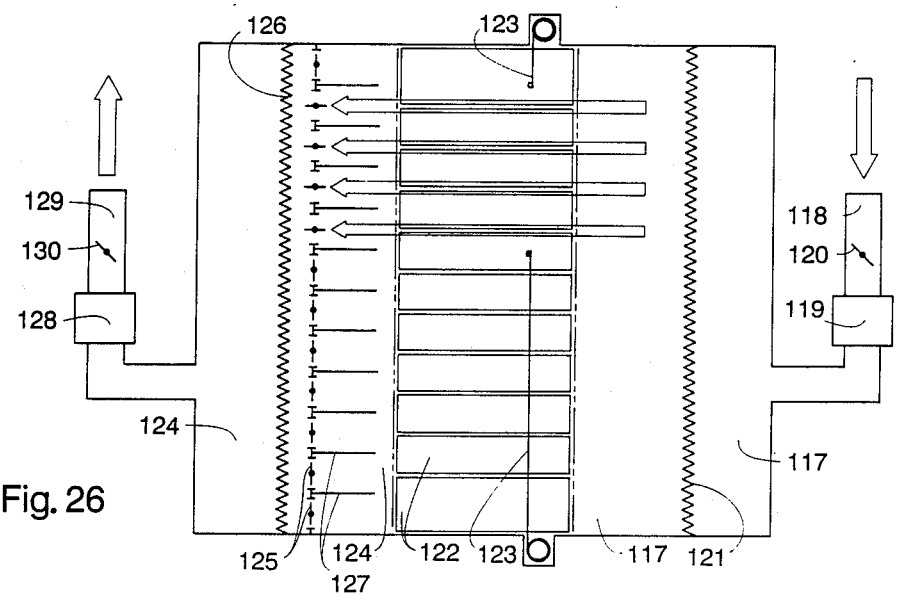
FIG. 26 is a schematic plan view of an embodiment of the invention in which a curtain panel is used at the supply face of the work chamber and an array of dampers is used at the exhaust face.
Figure 27:
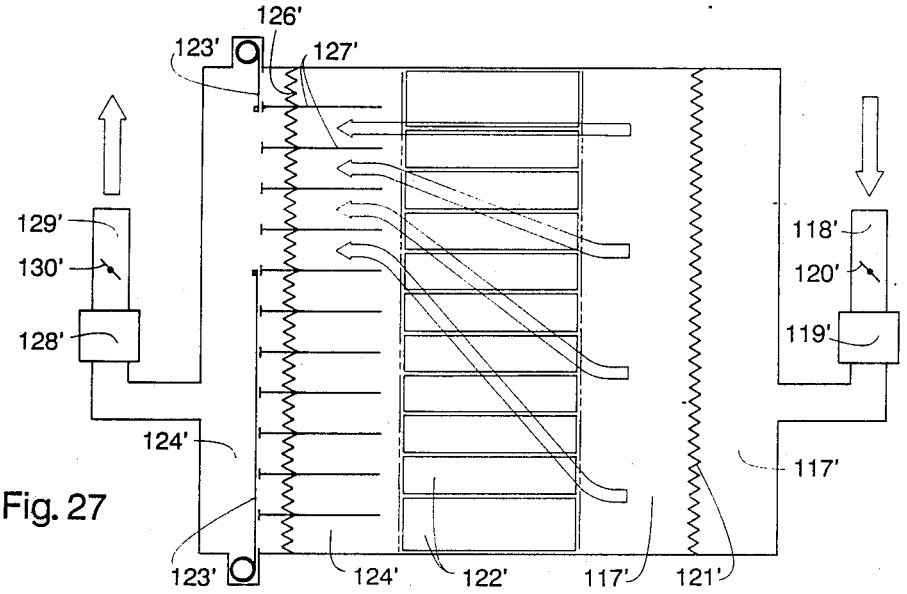
FIG. 27 is a schematic plan view of an embodiment of the invention in which a curtain panel is used at the exhaust face of the work chamber.

FIGS. 26 and 27 illustrate how the panels can be located in various positions within the supply air chamber, work chamber and exhaust chamber. Also illustrated is how one type of panel can work with or without partitions and can work in various combinations with another type of panel. Not shown in any of the schematics is access for the ingress and egress of the worker and workpiece.

FIG. 26 illustrates schematically a booth (down draft or side draft) of the present invention. Fresh air enters the supply air chamber 117 through conduit 118. A fan, make up air heater, and air conditioner (not shown) are contained in housing 119. The volume of air entering conduit 118 is controlled by flow control damper 120. Filter 121 removes dust particles from the supply air. The eleven sensor area subdivisions 122 of the work chamber are monitored by eleven automatic location sensors (not shown). Inside the work chamber, a spooling type panel 123 is located. Inside the exhaust chamber 124 is a damper type panel 125 and filter 126 and partitions 127 subdividing the exhaust face into twelve areas. In response to the activation of an automatic position sensor serving the third sensor area from the top, four subdivisions of the exhaust face are open due to the action of the damper type panel 125, and an equivalent opening is positioned opposite the opening in the exhaust face due to the action of spooling type panel 123. The activation of a single sensor is recognized as a location signal by the controller (not shown). In response thereto the controller operates the spooling type panel 123 and the damper type panel 125 so that the openings are properly positioned to their predefined locations. In this example the four dampers opposite the tripped sensor area are opened automatically; in addition, the opening in the spooling type panel 123 opposite the tripped sensor area is centered automatically. Should two adjacent sensors be tripped, the controller will recognize this signal as a location intermediate to the sensor areas. The zone in the damper type panel will be expanded to the width of five dampers and the zone in the spooling type panel will be centered opposite this new intermediate location. As shown, the ventilation is confined to approximately one-third of the work chamber. The exhaust fan (not shown) is mounted in housing 128. Exhaust air exits exhaust chamber 124 through conduit 129 and flow control damper 130.

FIG. 27 illustrates schematically a booth of the same capacity as that shown in FIG. 26, but with a spooling type panel in the exhaust chamber 124' only. Also, in the design shown in FIG. 27 the filter 126' in the exhaust chamber 124' is located upstream of the spooling type panel 123'. The result of having a spooling type panel 123' only in the exhaust chamber 124' is that the ventilating zone is not so strictly defined as in the apparatus depicted in FIG. 26. Still, the booth can be operated with a substantially lower rate of ventilating air than if neither the exhaust chamber nor the supply air chamber were fitted with fresh air confining means.

Figure 28:
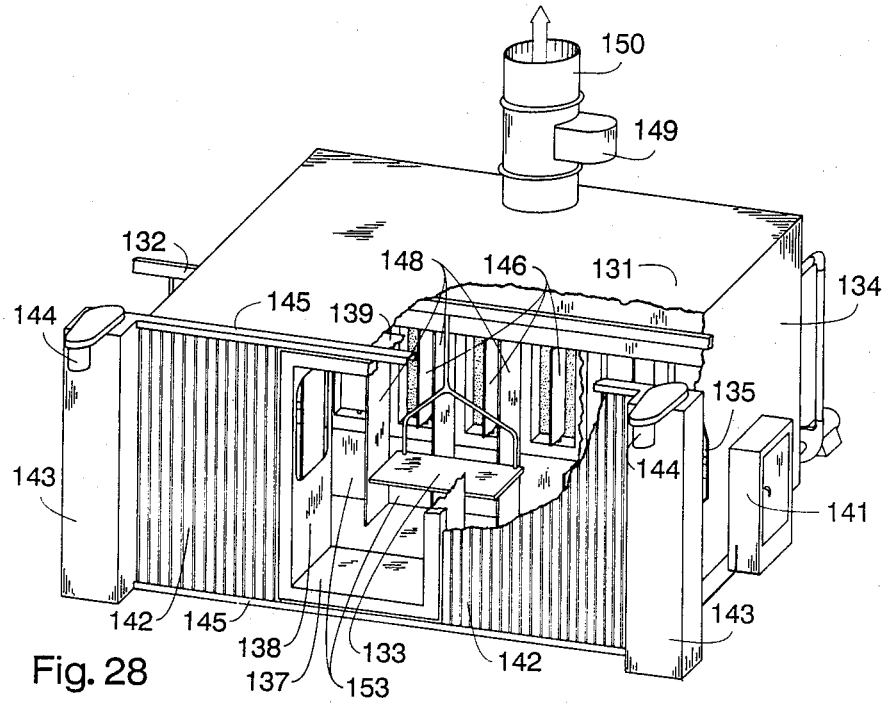
FIG. 28 is an isometric view (partially broken away) of a work chamber of the present invention in which an array of dampers is used at the exhaust face and a single curtain wall, with a cab alcove in it, is used at the supply face.
Figure 29:
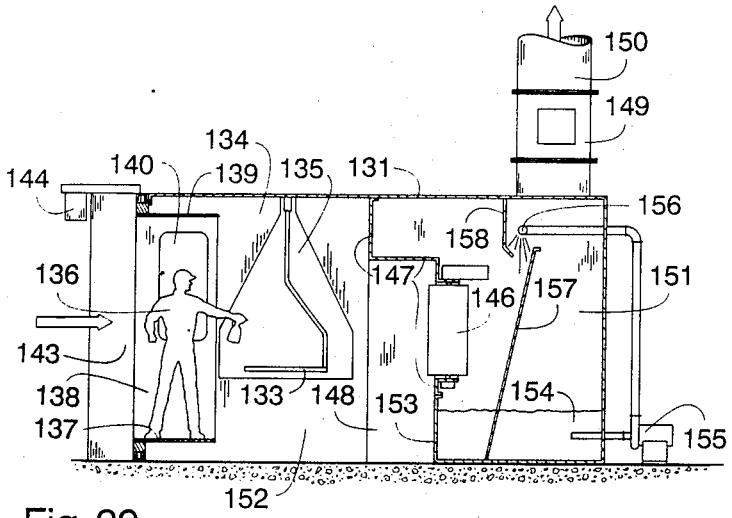
FIG. 29 is a side view (in partial cross section) of the work chamber depicted in FIG. 28.

FIGS. 28 and 29 depict a conveyorized booth of the present invention with both a damper type panel in the exhaust chamber and a spooling type panel in the work chamber, as illustrated schematically in FIG. 26, less the supply chamber.

FIG. 28 illustrates in a frontal isometric view, and FIG. 29 illustrates in a sectional side view, a booth of this arrangement. Suspended from the ceiling 131 is a monorail conveyor with track 132 and suspended trays 133 that slowly transport the workpieces to be sprayed (not shown) through the booth. Monorail 132 extends through the booth. Booth end walls 134 have openings 135 for the passage of the conveyor trays 133. The worker 136 (shown only in FIG. 29) rides back and forth in the full length of the booth in a motorized cab which is comprised of floor 137, walls 138 and ceiling 139. The worker sprays the workpiece from his vantage point in the cab. Like partitions, the cab further defines the opening in the spooling type panel. In this instance, the cab has the dimensions of four feet wide and eight feet high. Each wall 138 of the cab has a side window 140. The cab is equipped with a manual operator control (not shown) to signal the controller 141, which will in turn cause the cab to stop, or to move in a particular direction and speed, through its motive means. The spooling type panel's moving surface 142 is a curtain comprised of interlocking steel slats. This curtain surface 142 spools in and out from drums inside housing 143. Tension is maintained on this curtain surface 142 by tensioning devices 144 connected to the drums. The curtain surface 142 and the cab operate in tracks 145. The controller detects the location of the cab through a position encoder (not shown). The controller then opens three dampers 146 in panel frame 147 located upstream of the filter. Vertical partitions 148 extend from the damper panel frame 147 to the exhaust face. The overspray laden air is drawn through the open dampers 146 by an exhaust fan 149 to exit to the atmosphere through the exhaust stack 150. The exhaust chamber 151 is separated from the work chamber 152 by the damper type panel frame 147, dampers 146 and the lower wall portion 153. A pool of scrubbing water 154 stands in the exhaust chamber 151. The water is recirculated by pump 155 to spray header 156. The spray constantly wets baffles 157 and 158, which extend the entire length of exhaust chamber 151. Openings (not shown) near the bottom of baffle 157 allow water !54 to stand at the same level throughout exhaust chamber 151.

Figure 30:
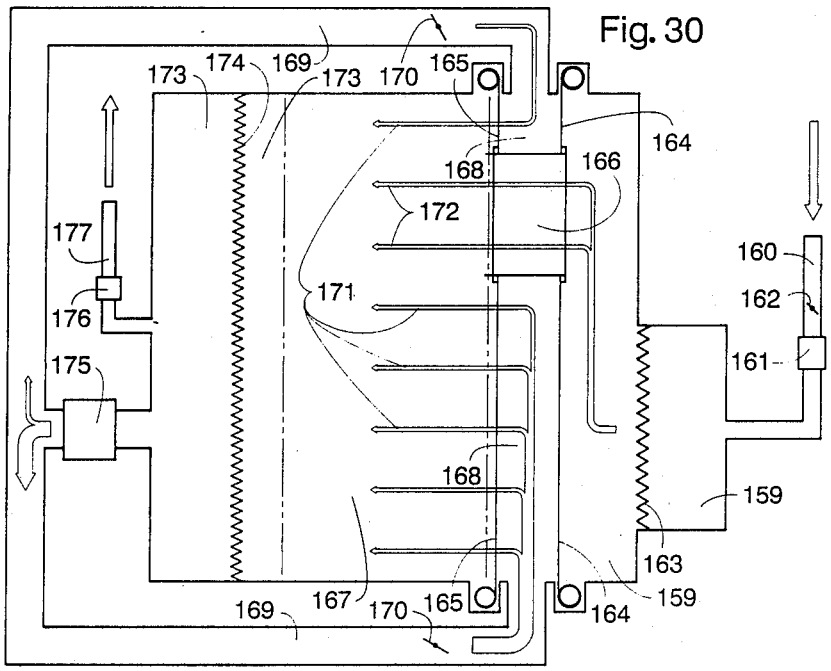
FIG. 30 is a schematic plan view of an embodiment of the present invention in which a double curtain wall, with a cab alcove, is used at the supply face of the chamber, and a portion of the exhaust air is recirculated through the chamber.
Figure 31:
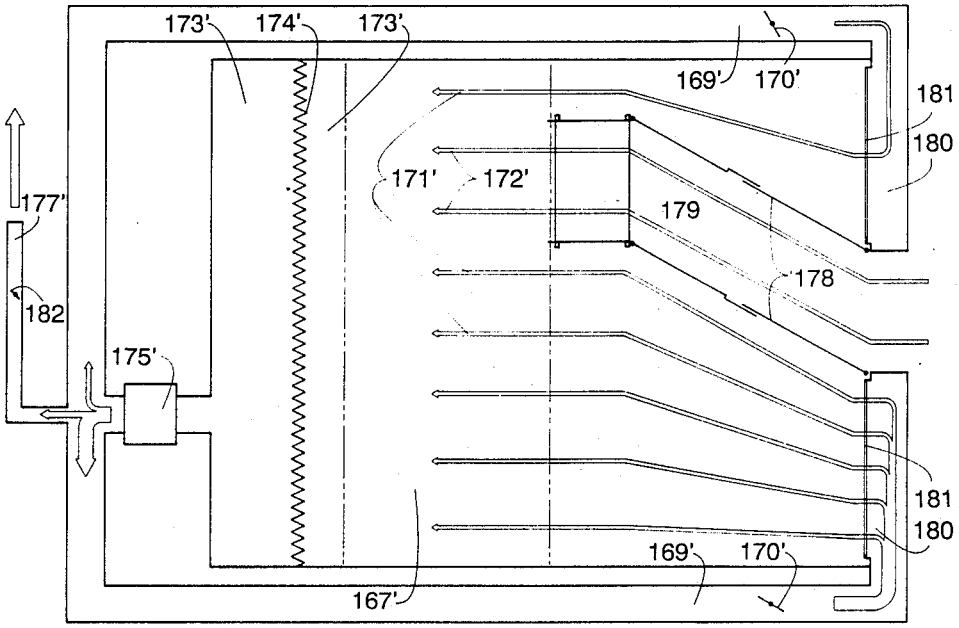
FIG. 31 is a schematic plan view of an embodiment of the invention in which a recirculation plenum and a mobile cab with an articulated access corridor are used at the supply face of the work chamber and a portion of the exhaust air is recirculated through the chamber.
Figure 32:
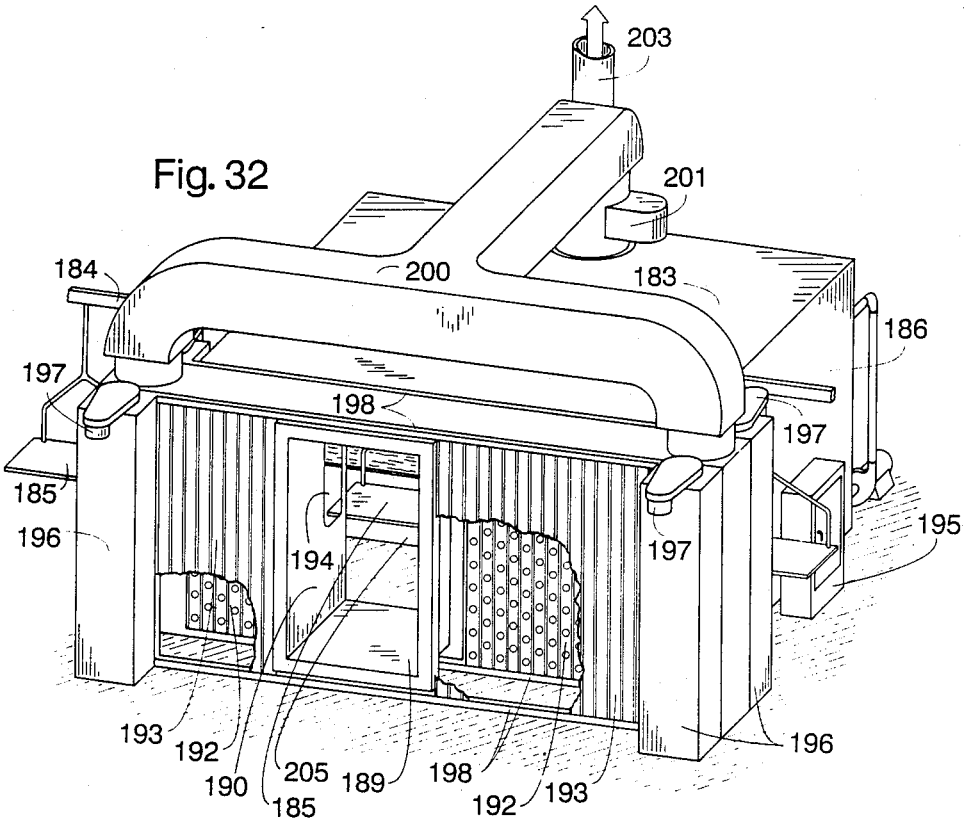
FIG. 32 is an isometric view (partially broken away) of a work chamber constructed according to the plan of FIG. 30.
Figure 33:
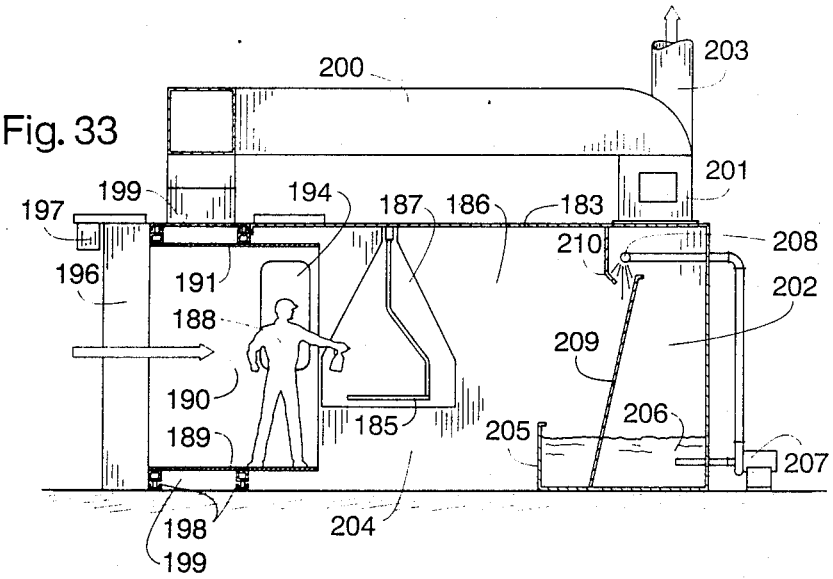
FIG. 33 is a side view (in partial cross section) of the work chamber depicted in FIG. 32.

FIG. 30 illustrates schematically a combination of spooling type panels to create a work chamber ventilated throughout its cross section by a combination of fresh mobile zone air and recirculated air. FIG. 31 illustrates a moving nozzle panel combined with a recirculation plenum to create a work chamber ventilated throughout its cross section by a combination of fresh mobile zone air and recirculated air. In both FIGS. 30 and 31 the fresh and recirculated components flow in substantially parallel paths. FIGS. 32 and 33 illustrates pictorially the booth schematically illustrated in FIG. 30, less the supply air chamber.

FIG. 30 illustrates schematically a booth (down draft or side draft) of the present invention. Fresh air enters the supply air chamber 159 through conduit 160. A fan, make up air heater, and air conditioner (not shown) are contained in housing 161. The volume of air entering conduit 160 is controlled by flow control damper 162. Filter 163 removes dust particles from the supply air. At the face of the supply air chamber 159, two spooling type panels 164 and 165 are located. An opening through both spooling type panels is defined by a cab 166. In response to manual control input by the worker, the cab 166 moves at the rate and in the direction selected by the worker to provide proper access to the workpieces in the work chamber 167. In conjunction with the movement of the cab, the curtain surface of each spooling type panel 164 and 165 winds up on a drum and pays out on the other drum. Spooling type panel 164 forms the upstream boundary and spooling type panel 165 forms the downstream boundary of recirculation chamber 168. Exhaust air enters each side of the recirculation chamber 168 by means of conduit 169. The volume of air entering each side of the recirculation chamber is controlled by flow control damper 170, in response to the proportion of each curtain surface area exposed in spooling type panel 165. The exhaust air 171 exits the recirculation chamber into the work chamber 167 through perforations (not shown) in the curtain surface of spooling type panel 165. Fresh mobile zone ventilating air 172 enters the work chamber 167 from the supply air chamber 159 through the cab 166. The work chamber is uniformly ventilated throughout its cross section by a combination of recirculated air 171 and fresh air 172. This ventilating air then enters the exhaust chamber 173 and passes through filter 174, which removes overspray from the exhaust stream. The larger portion of this exhaust air exits through the recirculation fan (not shown) in housing 175, whereupon the air is returned to the recirculation chamber 168 through conduit 169. The smaller portion of this exhaust air exits through the exhaust fan (not shown) in housing 176 to the atmosphere through exhaust stack 177. The volume of air exiting may be controlled by a flow control damper (not shown) in the exhaust stack 177. The ratio of air exhausted to air recirculated is proportional to the ratio of area of the opening as defined by the cab 166 in the spooling type panels 164 and 165 to the total area of perforated curtain surface in spooling type panel 165 in the booth cross section. By providing separate fan means for recirculation and exhaust, it is then possible to maintain the recirculation chamber 168 at slightly below atmospheric pressure. This is desirable because any air leakage through the seals of spooling type panel 164 will be in the preferred direction of fresh air into the recirculation chamber 168, rather than the undesirable direction of contaminated recirculation air from the recirculation chamber 168 into the fresh air supply.

FIG. 31 illustrates schematically a booth of the same capacity as that shown in FIG. 30, but with a different means of distributing the recirculated air and the mobile zone air. Fresh mobile zone air enters the work chamber 167' from the atmosphere through moving nozzle type panel 178 by means of an opening defined by cab 179 in the moving surface of the panel. The moving nozzle panel 178 is of the type as described in FIG. 21. Contaminated ventilating air enters each recirculation plenum 180 by means of conduit 169'. The volume of air entering each recirculation plenum 180 is controlled by flow control dampers 170' is response to the proportion of each cross sectional area of the booth exposed by moving nozzle type panel 178, respectively. The recirculated air 171' exits the recirculation plenums 180 into the work chamber 167' through perforations in the interior wall 181 of the plenum 180. The entire work chamber is uniformly ventilated by a combination of recirculated air 171' and fresh air 172' This ventilating air then enters the exhaust chamber 173' and passes through filter 174', which removes overspray from the exhaust air. The exhaust air exits the exhaust chamber 173' through the fan (not shown) in housing 175', whereupon the exhaust air is split. The larger portion is diverted into the recirculation conduit 167' and the smaller portion exits to the atmosphere through exhaust stack 177'. The volume of exhaust air exiting is controlled by flow control damper 182. The ratio of air exhausted to air recirculated is proportional to the ratio of area of the opening as defined by cab 179 on the moving nozzle panel 178 to the total area of the interior wall 181 in the recirculation plenum 180.

FIGS. 32 and 33 illustrate pictorially the schematic design of FIG. 30 less the supply chamber and using the fan means of FIG. 31. FIG. 32 is a frontal isometric view and FIG. 33 is a sectional side view. Suspended from the ceiling 183 is a monorail conveyor 184 with trays 185 that slowly transport the workpieces to be sprayed (not shown) through the booth. Monorail 184 extends through the booth. Booth end walls 186 have openings 187 for the passage of the conveyor trays 185. The operator 188 (shown only in FIG. 33) rides back and forth the full cross section of the booth in a motorized cab which is comprised of floor 189, walls 190 and ceiling 191. The worker sprays the workpiece from his vantage point in the cab. In this instance, the cab has the dimensions of four feet wide and eight feet high. Each wall 190 of the cab has a window 194. The cab is equipped with manual operator control input (not shown), such as a foot switch, to signal the controller 195, which in turn causes the cab to stop or to move in a particular direction and speed. The spooling type panels are comprised of curtains 192 and 193 which are fabricated from narrow, interlocking, steel slats. These curtains 192 and 193 spool in and out from drums inside housing 196. Tension is maintained on curtains 192 and 193 by tensioning devices 197 connected to the drums. The curtains and the cab operate in tracks 198. A recirculation chamber 199 is formed and bounded peripherally by the floor, walls, ceiling and the two spooling type panels. The downstream curtain 192 is perforated to permit exit of the recirculated air supplied by recirculation duct 200 from the combination exhaust and recirculation fan 201. By careful sizing and spacing of the holes in the perforated curtain 192, the curtain will act as a diffuser to evenly distribute the recirculated air across the booth cross section, thereby eliminating the need for dedicated flow control devices, such as the dampers 170 in FIG. 30.

The overspray laden air is drawn through the exhaust chamber 202 by the combination exhaust and recirculation fan 201 to exit to the atmosphere through the exhaust stack 203. The exhaust chamber 202 is separated from the work chamber 204 by the lower wall portion 205. A pool of scrubbing water 206 stands in the exhaust chamber 202. The water is recirculated by pump 207 to spray header 208. The spray constantly wets baffles 209 and 210, which, along with the spray, constitute a water wash filter, which extends the entire length of exhaust chamber 202. Openings (not shown) near the bottom of baffle 209 allow water 206 to stand at the same level throughout exhaust chamber 202.

Figure 34:
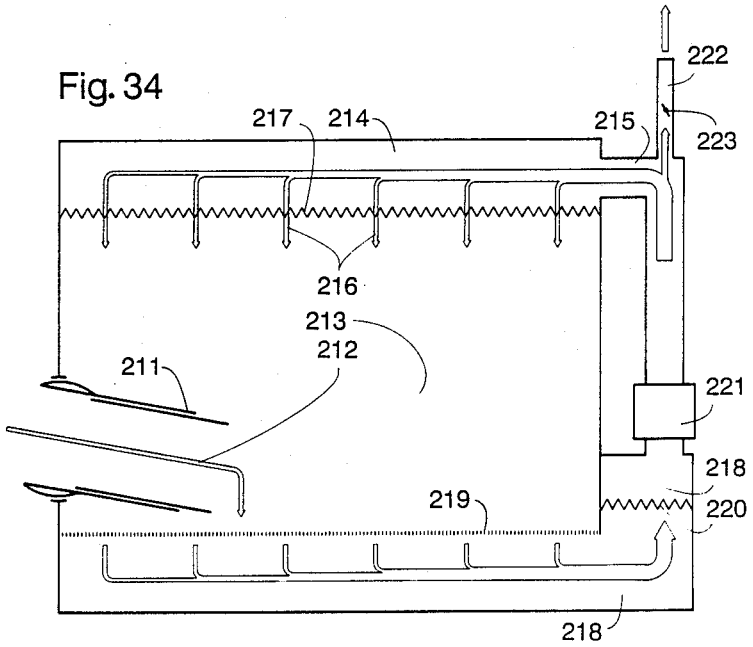
FIG. 34 is a schematic side view of a work chamber of the present invention with a combination swivel-extension/retraction type of ventilating air conduit, in which a portion of the exhaust air is recirculated through the chamber.
Figure 35:
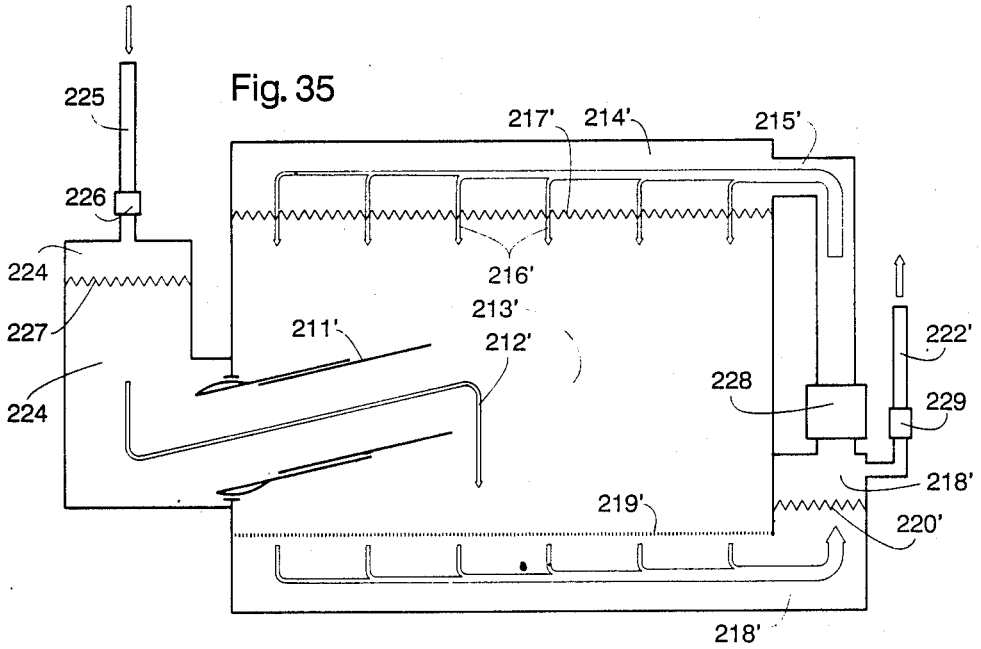
FIG. 35 is a schematic side view of a variation of the embodiment depicted in FIG. 34, in which a supply air chamber has been added, along with separate recirculation and exhaust fan means.
Figures 36, 37:
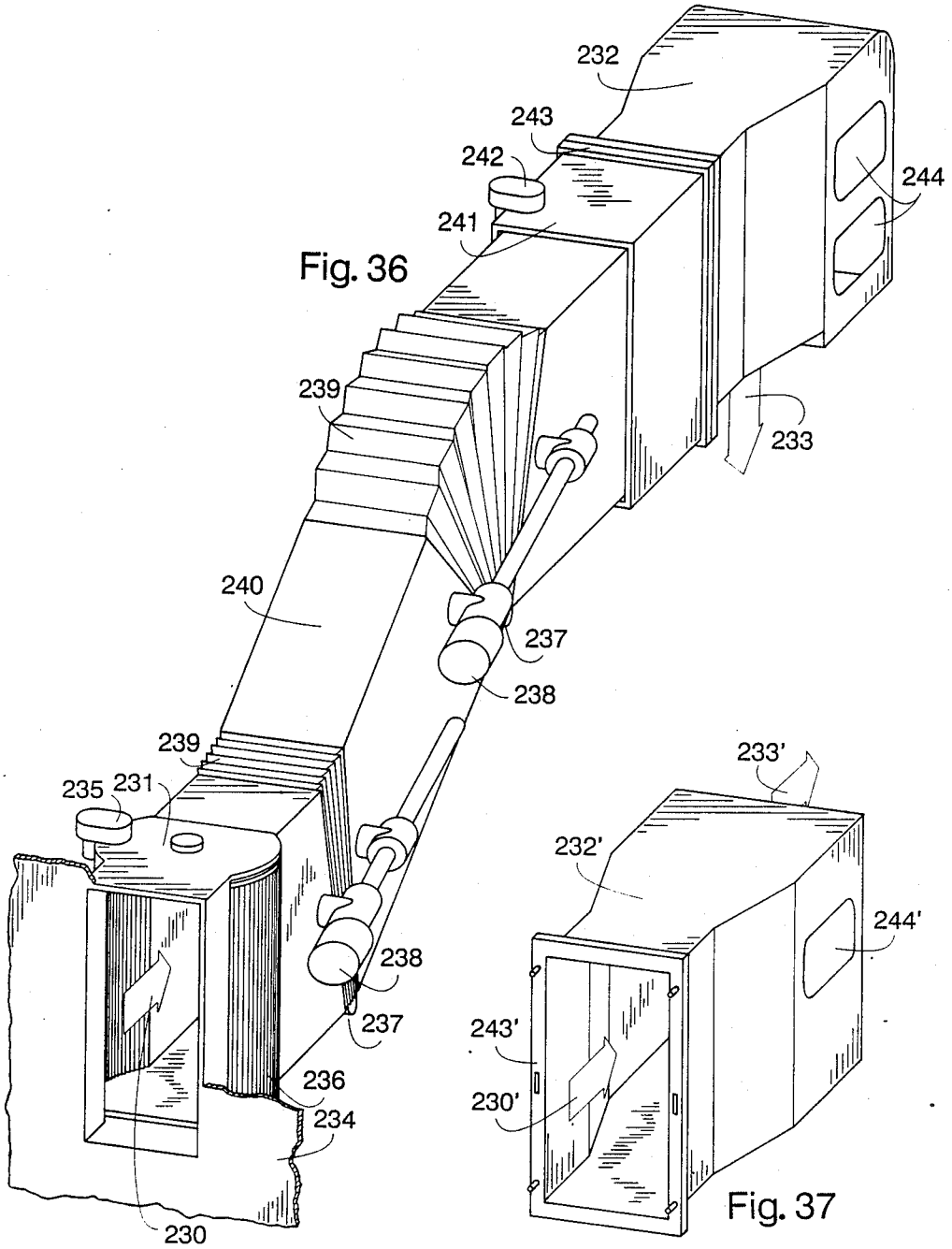
FIG. 36 is an isometric view (enlarged and partially broken away) of a swivel/extension ventilating air conduit of the type that can be used in the designs depicted in FIGS. 34 and 35.
FIG. 37 is an isometric view of an alternative work platform cab suitable for use in the corridor/cab embodiment depicted in FIG. 36.
Figure 38:
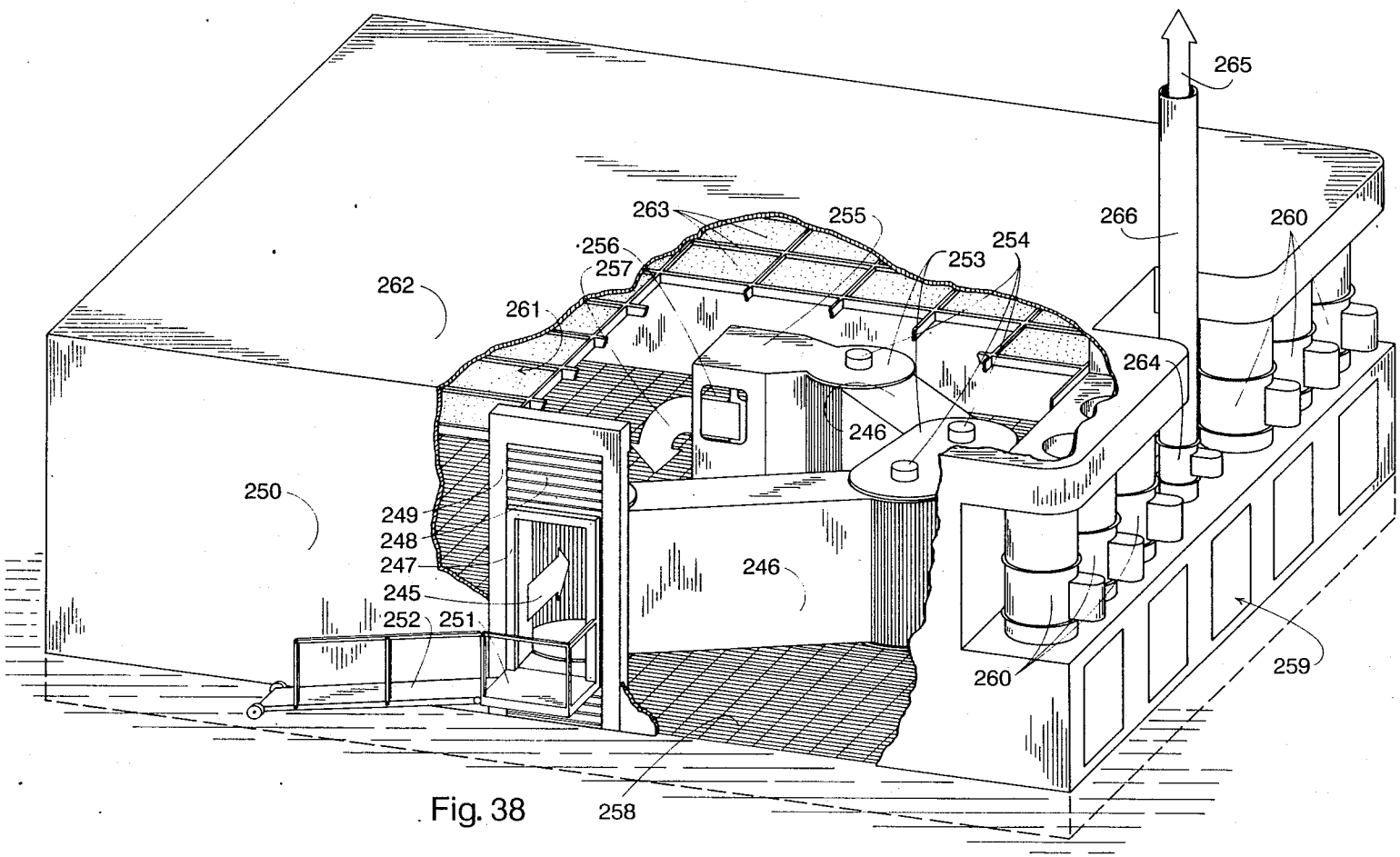
FIG. 38 is an isometric view (partially broken away) of the design schematically represented in FIG. 35, but without the supply chamber.

FIG. 34 illustrates schematically the use of a combination swivel-extension/retraction type panel of FIGS. 22 and 23 to create a work chamber ventilated throughout its cross section by a combination of fresh mobile zone air and recirculated air. FIG. 35 illustrates the same embodiment as illustrated in FIG. 34, except that a supply chamber has been added along with separate recirculation and exhaust fan means. In both FIGS. 34 and 35, the fresh and recirculated components are substantially perpendicular; this is in contrast to FIGS. 30 and 31, whose components are substantially parallel. FIG. 38 illustrates pictorially the booth schematically illustrated in FIG. 35, less the supply air chamber. FIGS. 36 and 37 pictorially elaborate on the combination swivel-extension/retraction panel of FIGS. 34 and 35.

FIG. 34 illustrates schematically a booth (down draft or side draft) of the present invention. The combination swivel-extension/retraction conduit 211 with cab (not shown) provides a passageway for the fresh mobile zone air 212, a walkway for the ingress and egress of the worker(s) and a work platform or cab for the worker(s). This cantilevered conduit 211 is capable of extending and retracting, elevating and traversing. In response to manual control input by the worker, the cab moves at a rate and direction selected by the worker to provide proper access to the workpiece in the work chamber 213. Alternatively, the movement can be directed by an automated control input according to a preprogrammed sequence. Exhaust air enters the recirculation chamber 214 by means of conduit 215. The recirculation air 216 exits the recirculation chamber into the work chamber 213 through filter 217. Fresh mobile zone ventilating air 212 enters the work chamber 213 from outside the booth through conduit 211. The entire cross section of the work chamber is uniformly ventilated by a combination of recirculated air 216 and fresh air 212. The mobile zone air 212 will change direction upon exiting the panel 211 toward the exhaust chamber 218. The contaminated ventilating air then enters the exhaust chamber 218 through the exhaust face 219 (which is also a floor with grating in a down draft booth) and passes through filter 220, which removes overspray. The exhaust air is drawn through the fan means (not shown) in housing 221, whereupon the contaminated air is split into two streams. The larger portion is diverted into the recirculation conduit 215 and the smaller portion exits to the atmosphere through exhaust stack 222. The volume of air exiting is controlled by flow control damper 223.

FIG. 35 illustrates schematically a booth of the same capacity as that shown in FIG. 34, with the addition of a supply air chamber and separate recirculation and exhaust fan means. Fresh air enters the supply air chamber 224 through conduit 225. A fan, make up air heater, and air conditioner (not shown) are contained in housing 226. Filter 227 removes dust particles from the supply air. The conduit 211' is shown in a retracted and lowered position, as compared to the conduit in FIG.

34. The contaminated ventilating air exits the work chamber 213' though the exhaust face 219' (which is also a floor with grating in a down draft booth) into the exhaust chamber 218' and passes through filter 220', which removes overspray. The exhaust air is then split into two streams. The larger portion passes through the recirculation fan means (not shown) contained in housing 228; the smaller portion passes through exhaust fan means (not shown) contained in housing 229 and finally exits to the atmosphere through exhaust stack 222'.

FIG. 36 illustrates a confining means which is an elaboration of the combination swivel-extension/retraction conduits found in FIGS. 22 and 23. The moving portion of this conduit is in the form of an articulated corridor. As shown, the conduit and cab would be suitable for two workers at the same time. It will provide a walkway for worker ingress and egress and a passageway for the fresh air, and the cab will provide a worker platform. As shown, this corridor and cab are capable of movement in a number of axes, so as to provide the workers with easy orientation and access to the workpiece. Fresh ventilating air 230 enters the first segment 231 of the articulated corridor. It proceeds through the corridor into the work platform cab 232, flows over the workers, and exits the work platform cab 232 as fresh air 233, into the main body of the work chamber (not shown). The upstream segment 231 of the corridor is also a swiveling joint which is attached to the booth wall 234. Movement of joint segment 231 is accomplished with actuator 235. Flexible structure 236 absorbs the extension and retraction of the joint, while maintaining a seal which isolates the interior of the corridor from the work chamber. Whereas corridor joint 231 provides movement in a horizonal plane, corridor joint 237 provides movement in a vertical plane. Movement of the joint is provided by actuator 238 and a seal is provided by accordion structure 239. Structure 240 is a typical segment of the corridor comprised of walls, ceiling and floor between the joints. Joint assembly 241 provides extension and retraction; movement of this joint is provided by actuator 242. Mating flanges 243 provide a means of attaching different configurations of work platform cabs 232 to the articulated corridor. The work platform cab 232 has walls, ceiling and windows 244. However, it has only a partial floor with the remaining area open, for this work platform is designed to facilitate downward access to the top surfaces of a workpiece. The shape of the work platform cab 232 forces the downward flow of fresh air 233.

The articulated corridor of FIG. 36 is cantilevered and motorized by actuators. Not shown is an alternative embodiment where the articulated corridor has additional support along its length. This support may include free swivelling or steerable wheels; the wheels may be of the motorized or idler type. Additionally, the wheeled support may have the capacity to raise and lower the articulated corridor by means of a motorized actuator. In an alternative embodiment a steerable, motorized, wheeled support assembly attached to the articulated corridor near the cab may provide the motive means for horizontal and vertical movement or the cab within the work chamber. In fact, the articulated corridor may resemble in form and movement the articulated passaqeway, called a jetway, which connects the passenger gate to the airliner at major airports.

FIG. 37 illustrates one configuration of work platform cab 232 suitable for attachment to an articulated corridor as shown in FIG. 36. Work platform cab 232' provides side access for the worker. The fresh air 230' blows straight through the cab 232' over the workers (not shown) and exits as mobile zone air 233'. The work platform cab 232' is provided with windows 244' and a mating flange 243'. The mating flanges are designed so that work platform cabs are interchangeable and may be easily mounted and dismounted. In this way, work platform cabs suitable for various size work crews and work platform cabs suitable for various access requirements can use the same articulated corridor.

FIG. 38 illustrates pictorially the schematic design of FIG. 35, less the supply chamber. FIG. 38 is a sectional isometric view of a booth of the present invention with recirculation. This is a typical batch type down draft booth. Doors (not shown) are opened to allow entrance of the workpiece. With the workpiece in the work chamber, the doors are then shut and work commences and is continued until completion. Upon completion the doors may be opened and the workpiece removed, thereby readying the booth for a repeat of this production cycle.

While work activity is taking place in the work chamber, fresh air 245 enters the articulated corridor 246 through an opening in the spooling type panel comprised of opening frame 247, curtain surfaces 248 and track and drum housing 249. The spooling type panel is mounted in the booth wall 250. The opening frame 247 moves up and down in this spooling type panel. Curtain surfaces 248 provide the seal for this movement. Attached to frame 247 is a pedestrian platform 251 and attached to this platform 251 is a hinged and wheeled pedestrian ramp 252. The ramp and platform provide the workers with convenient access to the articulated corridor, regardless of the elevation of the opening in the spooling type panel. The articulated corridor is attached to the frame 247. The frame both provides support to the articulated corridor and raises and lowers it, by means of an actuator (not shown). To provide mobility to the worker (not shown) and fresh mobile zone air 245, the articulated corridor is comprised of multiple corridor segments 246 with floor, walls and ceiling; multiple swivel joints 253 with their actuators 254; and cab 255. The worker rices in the work platform cab 255, which has a window 256. The cab's vertical movement is provided by the Frame 247 which raises and lowers the cantilevered, articulated corridor along with the cab 255. In this embodiment, the entire articulated corridor and cab always remain horizontal. The actuator powering the vertical movement of frame 247 is not shown. The cab's horizontal movement through the cross section of the work chamber is provided by the extention, retraction and rotation resulting from the combined action of the corridor segments 246 and their swivel joints 253. The work platform cab 255 is brought into working positions by means of either the manual control input of the worker or an automatic control input which follows a preprogrammed sequence. The mobile zone air 257 exits the cab 255 horizontally; however, it soon is deflected downward by the overwhelming mass of recirculated booth air moving vertically from ceiling to floor. Throughout the entire cross section of the work chamber, the recirculated air travels downward, exiting the chamber through the floor grating 258 and passing into the exhaust chamber 259. Contained in exhaust chamber 259 is the overspray filter (not shown) where particulates are removed. Filtered exhaust air is drawn up by the recirculation fans 260 and discharged into the recirculation chamber 261. The recirculation chamber 261 is formed by the booth ceiling 262, booth walls 250 and the diffuser assembly 263. The diffuser assembly is made up of a lattice support grid fitted with either diffusers or filters. The recirculation air is evenly distributed throughout the work chamber cross section into the work chamber in a downward direction. Part of the contaminated air from exhaust chamber 259 is drawn off by exhaust fan 264. This exhaust air 265 is discharged to pollution control equipment or to the atmosphere through stack 266. The quantity of exhaust air 265 exhausted is equal to the quantity of fresh air 245 introduced into the work chamber through the articulated corridor.

In conclusion, then, in the improved chamber of the present invention the zone of fresh ventilating air shifts in response to shifting locational needs of the work activity. The confining means of the present invention provides a movable opening through which fresh air flows over the worker. Additionally, the opening may be in a structure which serves as a conduit for the fresh ventilating air, a conduit for the ingress and egress of the worker, and mobile work platform for the worker. In this way, the linkage between work chamber size and quantity of air exhausted to the atmosphere is broken. The invention can also be described as the combination of a smaller, mobile work chamber or cab within a larger, stationary work chamber. The smaller, mobile work chamber provides additional zone definition, just as partitions provide. In the most beneficial embodiments, the smaller work chamber is occupied by the worker, while the larger work chamber containing the product remains unoccupied. This differs substantially from the prior art, since in the present chamber the introduction of fresh air into the chamber is limited to the area of the spraying activity and the openings for the entrance and exit of product. Recirculation can be incorporated with the work chamber of the present invention to promote laminar flow and provide additional overspray control. In this way the cross section of the booth (work chamber) can be ventilated with both fresh and recirculated air components.

I claim:

1. In a ventilated work chamber large enough to accommodate a worker and allow him to move about in the chamber and perform work activity in different locations in the chamber, said chamber being equipped with means for passing ventilating air through the chamber in a direction that is substantially perpendicular to a cross section of the chamber, at least a portion of said ventilating air being fresh air, and said air exiting the chamber through an exhaust face, and said chamber including means for exhausting to the atmosphere at least part of the air that exits the chamber, the improvement wherein the chamber includes (a) means for recirculating at least part of such ventilating air through the chamber, (b) a mobile, open cab operable to carry the worker from one location to another in the chamber and hold the worker as he performs his work activity in different locations in the work zone of the chamber, said cab having a rear portion and a front portion, and (c) means for delivering the fresh air to said cab from the rear, said cab and delivery means serving to substantially confine the fresh air component of the ventilating air passing through the chamber to a zone having a smaller cross section than the said cross section of the chamber, as well as to permit shifting of the location of said zone of moving fresh air about the chamber as the work activity shifts about the chamber, so as to be able to constantly maintain a flow of fresh air through the location of the work activity, even thought said location moves from place to place in the plane of the cross section of the chamber.

2. The work chamber of claim 1 wherein the means for recirculating air through the chamber includes a recirculation conduit, and the means is operable to maintain air pressure within the conduit below atmospheric pressure.

3. The work chamber of claim 1 wherein the means for exhausting air to the atmosphere includes a first fan and the means for recirculating air through the chamber includes a second fan.

4. The work chamber of claim 3 further including dry filter means for filtering air after it exits the chamber and before it is exhausted to the atmosphere.

5. The work chamber of claim 4 further including dry filter means for filtering the air that is recirculated through the chamber.

6. The work chamber of claim 1 wherein the cab is responsive to control means which is programmed to move the cab from one location to another in the chamber according to a predetermined sequence.

7. The work chamber of claim 1 wherein the location of the mobile cab is responsive to control means located in the cab and operable by the worker.

8. The work chamber of claim 1 wherein the cab is in direct communication with an area exterior to the work chamber, thus allowing ingress and egress of the worker to and from the cab, without having to pass through any region of the work chamber that lies outside the fresh air zone.

9. The work chamber of claim 8 wherein the delivery means comprises a flexible conduit connecting the cab with a source of fresh air.

10. The work chamber of claim 9 wherein the conduit includes an enclosed, articulated corridor extending from the cab to an area exterior to the work chamber.

11. The work chamber of claim 9 or 10 wherein the cab is capable of movement in two or more axes.

12. The work chamber of claim 9 or 10 wherein the cab is detachable from the corridor.

13. The work chamber of claim 10 wherein the work chamber has a floor and a ceiling, the exhaust face constitutes the floor of the chamber, which is in the form of a grate, and the recirculating air means is operable to return the air to the chamber through the ceiling of the chamber.

14. The work chamber of claim 1 or 13 wherein the cab has two sides, with windows in each side.

15. The work chamber of claim 1 further including a telescoping, enclosed walkway connecting the cab with an area exterior to the work chamber.

16. The work chamber of claim 15 wherein the telescoping walkway is pivotably mounted to an opening in the wall of the chamber.

17. The work chamber of claim 9 having two substantially parallel movable partitions that are parallel to the cross section of the chamber and are spaced apart so as to define an air space between them, one partition constituting an interior wall of the chamber and the other partition constituting an exterior wall of the chamber, and wherein said cab constitutes an alcove in the two partitions, said partitions and cab being operable to move in unison so as to reposition the cab in two directions along a path of movement that is substantially parallel to the cross section of the chamber, said interior partition wall being perforated sufficiently to allow air to pass therethrough, said exterior partition wall being substantially impervious to air, and the chamber includes motive means for moving said partition walls and cab, wherein the recirculating means includes means for withdrawing air from the chamber and delivering said withdrawn air to the space between said partition walls.

18. The work chamber of claim 17 wherein the partition walls and cab move in a horizontal direction and wherein each of the partition walls is a flexible curtain and the motive means includes four stationary, vertically disposed rollers, one attached to each end of each curtain wall, so that as the cab and walls move horizontally, the wall is taken up by one roller and is paid out by the other roller at the opposite end.

19. The work chamber of claim 18 wherein each partition wall comprises two flexible curtain segments, one on each side of the cab, and the motive means includes four vertically disposed rollers mounted on the cab, one end of each curtain segment being attached to its own roller, so that as the cab moves horizontally, each curtain segment on one side of the cab is taken up by its roller, while each curtain segment on the other side of the cab is paid out by its roller.

20. The work chamber of claim 17 wherein at least one of the partition walls is composed of sliding panels.

21. The work chamber of claim 17 wherein at least one of the movable partitions is a foldable assembly of panels hinged together.

22. The work chamber of claim 1 further including means for detecting when work activity in the chamber has ceased, means for measuring the length of time during which no work activity has taken place in the chamber, and means, responsive to a determination by said measuring means that no work activity has taken place in the chamber for a predetermined length of time, for reducing the volume of fresh air being passed through the chamber.

23. The work chamber of claim 22 additionally including fluid-carrying line means for use in performing said work activity in the chamber, and wherein the detecting means includes one or more sensors, selected from the group consisting of pressure sensors, flow sensors and mass sensors, operable to detect a changed condition with respect to the fluid in the line.

24. The work chamber of claim 1 further including thermostatically controlled means for tempering the fresh air before it is drawn into the chamber, means for detecting when work activity in the chamber has ceased, means for measuring the length of time during which no work activity has taken place in the chamber, and means, responsive to a determination by said measuring means that no work activity has taken place in the chamber for a predetermined length of time, for adjusting the temperature setting of said thermostat to a more economical setting.

25. The work chamber of claim 1 further including a plurality of electric lights operable to illuminate the interior of the chamber, means for detecting when work activity in the chamber has ceased, means for measuring the length of time during which no work activity has taken place in the chamber, and means, responsive to a determination by said measuring means that no work activity has taken place for a predetermined length of time, for turning off at least some of said lights.

* * * * *